US012484662B1

(12) United States Patent
Daniel et al.

(10) Patent No.: US 12,484,662 B1
(45) Date of Patent: Dec. 2, 2025

(54) DEPLOYABLE SHOE SOLE

(71) Applicant: Nir Daniel, Tel Aviv (IL)

(72) Inventors: Nir Daniel, Tel Aviv (IL); Galia Daniel, Tel Aviv (IL)

( * ) Notice: Subject to any disclaimer, the term of this patent is extended or adjusted under 35 U.S.C. 154(b) by 0 days.

(21) Appl. No.: 19/023,676

(22) Filed: Jan. 16, 2025

(51) Int. Cl.
*A43B 3/24* (2006.01)
*A43B 13/36* (2006.01)

(52) U.S. Cl.
CPC ..... *A43B 13/36* (2013.01); *A43B 3/24* (2013.01); *A43B 3/248* (2013.01)

(58) Field of Classification Search
CPC ..... A43B 1/0009; A43B 3/24; A43B 3/248; A43B 13/181
USPC ..... 36/27, 100
See application file for complete search history.

(56) References Cited

U.S. PATENT DOCUMENTS 6,807,753 B2 10/2004 Steszyn et al.
6,983,553 B2 1/2006 Lussier et al.
7,694,435 B1 * 4/2010 Kiser ..... A43B 3/24 36/11.5
10,986,895 B2 4/2021 Daniel et al.
11,564,438 B1 * 1/2023 Daniel ..... A43B 3/246
11,974,635 B2 * 5/2024 Daniel ..... A43B 3/108
2015/0223560 A1 * 8/2015 Wawrousek ..... A43B 13/223 36/25 R
2020/0107609 A1 * 4/2020 Ahn ..... A43B 13/181
2020/0378462 A1 * 12/2020 Rennex ..... A43B 13/183
2023/0082535 A1 * 3/2023 Vu ..... A43B 13/38 36/28
2024/0315392 A1 * 9/2024 Huang ..... A43B 13/186
2024/0365923 A1 * 11/2024 Salari-Sharif ..... A43B 13/186
2024/0415228 A1 * 12/2024 Altrogge ..... A43B 13/186

* cited by examiner

*Primary Examiner* — Marie D Bays
(74) *Attorney, Agent, or Firm* — The Law Office of Joseph L. Felber

(57) ABSTRACT

A deployable shoe sole transitioning between a compacted state and a deployed state, incorporating a deployable structure with a first and second structural element hingedly connected to enable movement in a deployment direction. The first and second structural elements include congruent abutment surfaces that abut in the deployed state to limit further movement, ensuring stability under load. In the compacted state, the abutment surfaces form an angle to reduce the sole's volume.

19 Claims, 23 Drawing Sheets

DEPLOYABLE SHOE SOLE

TECHNICAL FIELD

The present disclosure relates to footwear and more particularly to deployable shoe soles that can transition between storage and deployed states.

BACKGROUND

The footwear industry has consistently innovated to meet consumer demands for comfort, performance, and style. However, traditional shoe designs are inherently bulky, posing challenges for efficient storage, shipping, and personal organization. As global shipping costs rise and sustainability becomes a critical concern, industries are increasingly seeking solutions to minimize wasted space in transportation and storage.

In parallel, consumers are looking for ways to optimize space at home and during travel. Shoes, often one of the most space-consuming items, require significant room in luggage or storage areas, which can be a particular challenge in compact living spaces or for frequent travelers.

Recognizing these trends, there is a growing need for footwear that can reduce its physical footprint during periods of non-use while maintaining full functionality when deployed. A solution that addresses this need would not only align with evolving consumer expectations but also drive efficiencies across the supply chain, reducing shipping air volume and storage requirements. Some such solutions have been disclosed in U.S. Pat. Nos. 11,974,635 B2, and 10,986,895 B2. Other aspects to be discussed hereinafter refer to modification of shoe soles, either deployable or not, so as to change their operational characteristics. Some such solutions have been disclosed in U.S. Pat. Nos. 6,807,753 B2, and 6,983,553 B2.

GENERAL DESCRIPTION

Traditional shoe soles occupy substantial volume even when not in use, posing challenges for storage and transport. The presently disclosed subject matter t addresses these challenges by enabling substantial volume reduction in the compacted state while maintaining proper support characteristics during use. A deployable shoe sole is disclosed. It can include a deployable structure comprising a first structural element and a second structural element that can be hingedly connected to each other so as to enable hinged movement at least in a deployment direction. The first structural element can have a first abutment surface and the second structural element can have a second abutment surface. The first and second abutment surfaces can be congruent. The deployable shoe sole can be configurable between a compacted state in which the first and second abutment surfaces are separated, and a deployed state in which the abutment surfaces abut each other so as to limit further hinged movement between the first structural element and the second structural element in the deployment direction. This basic arrangement enables controlled deployment while ensuring stable support through natural stopping points. In the compacted state, the first and second abutment surfaces can form an angle therebetween. This angle can be greater than 30 degrees, enabling significant volume reduction while preventing material stress at the hinge points. The first structural element can be a load bearing structural element and the second structural element can be a geometrically locking structural element oriented laterally thereto in the deployed state of the sole. The geometrically locking structural element can have a load bearing abutment surface configured to abut an abutment surface of the load bearing structural element in the deployed state of the sole, and a geometrically locking abutment surface configured to abut an abutment surface of another geometrically locking structural element. This arrangement provides both load distribution and structural stability through geometric relationships rather than additional mechanical components. The geometrically locking structural element can be oriented perpendicular to the load bearing structural element in the deployed state of the sole, maximizing the locking effect under vertical loads.

The geometrically locking structural element can be hingedly connected at one end thereof to the load bearing structural element and at an opposite end thereof to a like-geometrically locking structural element being parallel thereto in the deployed state of the sole. This arrangement creates pairs of geometrically locking elements that work together to maintain structural stability. Each of the geometrically locking structural elements can have a locking abutment surface abutting a respective locking abutment surface and arranged parallel to a direction of expected load to be applied on the sole, at the deployed state of the sole. The direction of expected load can be vertical. This parallel arrangement ensures that applied loads actually enhance the locking effect rather than working against it. The abutment surfaces of the geometrically locking structural elements can be configured to change their orientation by more than 60 degrees between the compacted and deployed states, and particularly 90 degrees. This significant orientation change enables both efficient storage and reliable locking. The geometrically locking structural elements can extend along bottommost and/or topmost parts of the sole. This strategic positioning maximizes the locking effect where it's most needed while allowing more traditional load-bearing elements in the central regions. The deployable shoe sole can comprise a plurality of structural elements, each connected to at least two other structural elements, so as to create a repeating pattern. This interconnected arrangement provides comprehensive support across the sole area. The repeating pattern can include polygonal spaces in between structural elements, creating an efficient geometric structure. The polygonal spaces can include n sides in a center portion of the sole, and n−1 sides on topmost and/or bottommost portions of the sole, accommodating the transition between load-bearing and locking regions. Transition of any structural element between states can initiate corresponding transition of all other structural elements, ensuring coordinated deployment. The abutment of each of the abutment surfaces in the pattern can occur simultaneously, creating stable support throughout the sole.

A deployable shoe sole assembly can include a sole ceiling, a sole floor, and a sole space defined between them. The sole floor can be movable with respect to the sole ceiling at least during deployment to expand and contract the sole space. A plurality of spacer elements can be arrangeable upright in the sole space at least when the sole space is expanded. Each spacer element can have corresponding engagement features through which it can be secured at an angle with a mating spacer element so as to support the sole ceiling above the sole floor at a predetermined distance at a deployed state of the sole. This arrangement enables both efficient storage and stable support while allowing controlled flexibility. At least one of the spacer elements can be flat, providing efficient storage while maintaining the ability to provide structural support when deployed. The engagement features can comprise slits, enabling simple yet effective connection between elements. The slits of at least one spacer element can be wider than a thickness of the respective mating spacer element configured to engage therewith, enabling controlled flexing at connection points while maintaining structural integrity. Each spacer element can be connected to at least one of the sole ceiling or the sole floor, and this connection can be a hinge connection. This secure yet flexible attachment ensures proper positioning while enabling deployment motion.

The plurality of spacer elements can comprise more than three spacer elements arranged in a crisscross fashion, creating a comprehensive support network through their intersecting arrangements. The spacer elements can be made of a rigid or semi-rigid material, enabling both structural support and controlled flexing when secured in position. The spacer elements can have different sizes to provide varying predetermined distances between the sole ceiling and the sole floor when secured in the sole space, allowing customization of support characteristics across different regions of the sole. Each spacer element can comprise a sheet material capable of flexing when secured in the sole space. The sheet material can have a thickness-to-length ratio between 1:20 and 1:40, providing optimal balance between structural support and controlled flexibility. In a compacted state of the sole assembly, the spacer elements can be arranged to assume a general orientation that is substantially parallel to at least one of the sole ceiling and the sole floor, enabling significant volume reduction. The engagement features of each spacer element can comprise a first set of engagement features along a first edge portion and a second set of engagement features along a second edge portion, where the first and second sets of engagement features can be configured to engage with corresponding features of different mating spacer elements. Each spacer element can comprise a medial portion between its engagement features, where the medial portion can be configured to flex in a controlled manner when the spacer elements are secured in the sole space under load. Mating spacer elements can be configured to engage through their engaging features at a crossing angle of, for example, between 60 and 120 degrees, optimizing both structural stability and flexing characteristics. The spacer elements can comprise surface textures for enhancing grip at intersection points, ensuring secure engagement during use.

A deployable shoe sole can be configured to undergo deployment from a compacted state to a deployed state. The deployable shoe sole can include a sole ceiling and a wing structure that can be hingedly connected to the sole ceiling. The wing structure can comprise a plurality of wing elements that can be hingedly connected to each other. The deployable shoe sole can be configurable between a deployed state in which at least one wing element can be an upright extending wing element extending upright, vertically, relative to the sole ceiling, and a compacted state in which the plurality of wing elements can be arranged parallel to each other. one wing element extends substantially downwards from the sole ceiling, one is substantially level with the ground and another extending upright therefrom to the sole ceiling.

The term "upright" throughout the specification and claims denotes a substantially vertical orientation intended to absorb vertical loads.

The deployable shoe sole can include a first wing structure hingedly connected to a first side of the sole ceiling and a second wing structure hingedly connected to a second opposite side of the sole ceiling, creating balanced support across the sole width. The sole ceiling can have a central longitudinal axis, and each wing structure can be symmetrically connected to the sole ceiling with respect to this axis, ensuring even load distribution.

The first and second wing structures can be configured to interlock with each other through their respective wing elements most distal from their hinged connection to the sole ceiling, providing additional stability in the deployed state.

Each wing element can comprise abutment surfaces, and adjacent abutment surfaces of adjacent wing elements can be configured to abut each other in the deployed state, so as to limit further hinged movement in a direction of deployment. These abutment surfaces can be oriented at an angle between 60 and 120 degrees with respect to a plane defined by their respective wing element, optimizing both deployment motion and structural stability. Each wing structure can comprise at least three wing elements, providing sufficient structural components for stable support. In the deployed state, at least one wing element can be a ground engaging wing element arranged substantially horizontally. The ground engaging wing element can be positioned between and hingedly connected to at least two adjacent wing elements at opposite sides thereof, creating a stable base configuration. The wing elements of each wing structure can be sequentially connected to form a chain of wing elements, where a first wing element in the chain can be hingedly connected to the sole ceiling, and each subsequent wing element can be hingedly connected to a preceding wing element in the chain. This sequential arrangement enables controlled deployment while maintaining structural relationships. The deployable shoe sole can further comprise a plurality of directionally resilient supporting elements incorporated in the upright extending wing element. Each directionally resilient supporting element can be configured to compress under vertical load applied to the sole in a deployed state, and return to an original position when the load is removed. These supporting elements can be configured to maintain lateral stability perpendicular to direction of resiliency. Each directionally resilient supporting element can have an upper portion oriented at an angle with respect to a vertical, a lower portion oriented at an angle with respect to both the upper portion and the vertical, and a bend portion connecting therebetween. The bend portion can be reinforced compared to the upper and lower portions, enabling it to handle concentrated forces while maintaining directional stability. In a simple sense, reinforcing means that it is thicker than each of the portions.

A deployable shoe sole can include a nested element configuration enabling efficient storage while providing stable support during use. A deployable shoe sole can include a sole ceiling and a movable sole floor. A sole space can be defined between the ceiling and floor. A plurality of hollow elements can be configured to nest one within another. The sole can be configurable between a deployed state and a storage state. In the deployed state, the hollow elements can be arranged in the sole space. In the storage state, the hollow elements can be nested one within another outside the sole space.

Each hollow element can have a skewed configuration providing resilient support. The elements can have progressively varying sizes enabling them to nest efficiently. The sole space can be expandable to receive the elements and contractible to secure them in position.

Each hollow element can comprise a first end having a first cross-sectional area and a second end having a second, larger cross-sectional area. The elements can be skewed such that central axes of the first and second ends can be offset relative to each other.

Rotatable inserts can have an open cross-sectional shape providing a gap. The gap can be defined between wall portions. In polygonal configurations, each wall can comprise at least one through-hole.

The shoe sole can be enhanced through rotatable inserts having open cross-sectional shapes. These inserts can provide adjustable bounciness characteristics while maintaining compact storage capability. Each insert can have a gap enabling controlled deformation under load. The inserts can be rotatable to adjust their gap orientation, thereby modifying bounce response. The gap's orientation relative to the expected load direction significantly influences the insert's resistance characteristics. When the gap is oriented directly under the vertical load (i.e., at the top or bottom position), the insert provides maximum compression capability and thus maximum bounce response. This is because the gap allows the insert's walls to flex inward more freely. Conversely, when the gap is oriented to the side (i.e., 90 degrees rotation from the vertical), the insert provides greater resistance to compression, as the continuous portion of the insert directly opposes the vertical load.

The width of the gap also plays a crucial role in determining the insert's performance characteristics. The gap width can be engineered to be wider at the outer circumference and narrower at the inner circumference, creating a graduated compression response. Alternatively, the gap width can be uniform throughout, providing more linear compression characteristics. According to some implementations, the gap width ranges from 5% to 15% of the insert's circumference, with wider gaps enabling greater compression and narrower gaps providing more resistance. The gap edges can be parallel or slightly angled relative to each other, further influencing the compression characteristics.

This combination of adjustable gap orientation and carefully engineered gap dimensions enables fine-tuning of the sole's performance characteristics without requiring any additional components or mechanisms. A user can simply rotate the insert to achieve different levels of support and bounce response, while the gap's dimensional properties ensure consistent and reliable performance in each orientation The inserts can be accommodated within the hollow elements or within dedicated receiving pockets.

The rotatable inserts can be manufactured from resilient material. This material can be configured to bounce back to its original form after compression. Multiple through-holes can be arranged around the insert's circumference. These holes can align with holes in their receiving structures. In polygonal configurations, each wall can comprise at least one through-hole, enabling multiple securing positions.

The rotatable inserts can be accommodated within the nested hollow elements. The nested elements can thus serve as receiving pockets for the inserts. Through-holes of both components can align to receive the locking member. The locking member can thus secure both the nested structure and the rotatable inserts simultaneously.

The inserts can vary in both diameter and length. Different diameters can enable nesting while different lengths can accommodate varying sole widths. Multiple inserts can nest concentrically when removed from the sole.

A locking member can be provided to maintain deployed configurations. The sole can include aligned holes for receiving the locking member. An accommodation mechanism can engage with an edge portion of the locking member to secure it in position.

Each hollow element can have a skewed configuration providing resilient support. The elements can have progressively varying sizes enabling them to nest efficiently. The sole space can be expandable to receive the elements and contractible to secure them in position.

The shoe sole can be enhanced through rotatable inserts having open cross-sectional shapes. These inserts can provide adjustable bounciness characteristics while maintaining compact storage capability. Each insert can have a gap enabling controlled deformation under load. The inserts can be rotatable to adjust their gap orientation, thereby modifying bounce response. The inserts can be accommodated within the hollow elements or within dedicated receiving pockets.

A locking member can be provided to maintain deployed configurations. The sole can include aligned holes for receiving the locking member. An accommodation mechanism can engage with an edge portion of the locking member to secure it in position.

Alternatively or additionally, the shoe sole can incorporate a rolling configuration for achieving compact storage. This configuration can include an array of support elements extending from the sole ceiling. Adjacent support elements can define channels therebetween, enabling transformation between a deployed state where the elements are arranged upright and a rolled state where they arrange along a curved path. This rolling capability provides a unique solution for volume reduction while maintaining structural integrity.

For example, Adjacent support elements can define channels therebetween. The sole can be configurable between a deployed state with elements arranged upright and a rolled state with elements arranged along a curved path.

The support elements can have varying heights along the sole length, with heel region elements being higher than forefoot elements. This height variation serves multiple purposes—it provides anatomically appropriate support in the deployed state while enabling smooth rolling motion during transformation. Support elements can also have different base surface heights, enabling customization of pressure distribution for enhanced comfort and functionality.

Each support element can include inclined surfaces defining the channels with adjacent elements. These channels can have a first maximal width in the deployed state and a second, smaller maximal width in the rolled state. This geometric relationship ensures stable support when deployed while enabling efficient volume reduction through rolling. The inclined surfaces can abut each other in the rolled state, creating a secure compact configuration.

The support elements can incorporate geometric features that control the rolling motion, preventing lateral deviation while ensuring smooth transformation. These features enable reliable deployment and compact storage while maintaining the elements' proper relationships for subsequent reuse.

The locking member can be particularly adapted for the rolling configuration, extending through aligned holes in the support elements. This arrangement prevents unintended rolling while enabling intentional transformation when desired. The integration of the locking mechanism with the rolling structure demonstrates how different aspects of the invention can be combined to enhance overall functionality.

Different securing arrangements can be provided. The locking member can incorporate various edge configurations for engagement. The accommodation mechanism can be adapted to different sole configurations while maintaining its securing function.

Support elements in the rolling configuration can incorporate features from other embodiments. Their channels can accommodate additional supporting components. Their through-holes can be adapted to different locking member configurations.

The deployable configurations described in the various embodiments can be implemented across different scales, including meta-material applications. Particularly, the geometrically locking structural elements can be arranged in microscale patterns to create materials with unique mechanical properties and controlled state transitions. This scalability enables applications beyond traditional footwear while maintaining the fundamental principles of deployment and structural stability.

Embodiments

1. A deployable shoe sole configured to undergo deployment from a compacted state to a deployed state, incorporating a deployable structure comprising:
   a first structural element; and
   a second structural element hingedly connected to the first structural element so as to enable hinged movement between the first structural element and the second structural element at least in a deployment direction;
   the first structural element has a first abutment surface and the second structural element has a second abutment surface;
   the first and second abutment surfaces being congruent;
   wherein, in the compacted state in which the first and second abutment surfaces are separated, and at the deployed state in which the abutment surfaces abut each other so as to limit further hinged movement between the first structural element and the second structural element in the deployment direction.
2. The deployable shoe sole according to embodiment 1, wherein in the compacted state, the first and second abutment surfaces form an angle therebetween.
3. The deployable shoe sole according to embodiment 2, wherein the angle formed between the first and second abutment surfaces in the compacted state is greater than 30 degrees.
4. The deployable shoe sole according to any one of embodiments 1 to 3, wherein the first and second abutment surfaces are flat.
5. The deployable shoe sole according to embodiment 1, wherein the first structural element is a load bearing structural element and the second structural element is a geometrically locking structural element oriented lateral thereto in the deployed state of the sole, the geometrically locking structural element having a load bearing abutment surface configured to abut an abutment surface of the load bearing structural element in the deployed state of the sole, and a geometrically locking abutment surface configured to abut an abutment surface of another geometrically locking structural element.
6. The deployable shoe sole according to Embodiment 5, wherein the geometrically locking structural element is oriented perpendicular to the load bearing structural element in the deployed state of the sole.
7. The deployable shoe sole according to embodiment 5 or embodiment 6, wherein the geometrically locking structural element being hingedly connected at one end thereof to the load bearing structural element and at the opposite end thereof to a like-geometrically locking structural element being parallel thereto in the deployed state of the sole.
8. The deployable shoe sole according to any one of embodiments 5 to 7, wherein each of the geometrically locking structural elements have a locking abutment surface abutting a respective locking abutment surface and arranged parallel to a direction of expected load to be applied on the sole, at the deployed state of the sole.
9. The deployable shoe sole according to Embodiment 8, wherein the direction of expected load is vertical.
10. The deployable shoe sole according to any one of embodiments 8 and 9, wherein the abutment surfaces of the geometrically locking structural elements are configured to change their orientation by more than 60 degrees between the compacted and deployed states, and particularly 90.
11. The deployable shoe sole according to any one of embodiments 5 to 10, wherein geometrically locking structural elements extend along a bottommost and/or topmost parts of the sole.
12. The deployable shoe sole according to any one of the preceding embodiments, comprising a plurality of structural element, each connected to at least two other structural elements, so as to create a repeating pattern.
13. The deployable shoe sole according to embodiment 12, wherein the repeating pattern includes polygonal spaces in between structural elements.
14. The deployable shoe sole according to embodiment 13, wherein the polygonal spaces include n sides in a center portion of the sole, and n−1 sides on topmost and/or bottommost portions of the sole.
15. The deployable shoe sole according to any one of embodiments 12 to 14, wherein transition of any structural element between states initiates corresponding transition of all other structural elements.
16. The deployable shoe sole according to any one of embodiments 12 to 15, wherein the abutment of each of the abutment surfaces in the pattern occur simultaneously.
17. The deployable shoe sole according to any one of the preceding embodiments, wherein the deployable structure is a truss and the first and second structural elements are truss elements.
18. The deployable shoe sole according to any one of the preceding embodiments, wherein each of the first and second structural elements comprises a portion of rigid material from which the respective abutment surface is made.
19. The deployable shoe sole according to embodiment 18, further comprising a flexible material connecting the portions of rigid material of the first and second structural elements.
20. The deployable shoe sole according to embodiment 19, wherein the flexible material facilitates the hinged connection between the first and second structural elements.
21. The deployable shoe sole according to any one of Embodiments 12 to 14, wherein: each first structural element is hingedly connected to at least two second structural elements; and each second structural element is hingedly connected to at least two first structural elements, thereby forming a repeating hexagonal pattern in the deployed state.

22. A deployable shoe sole configured to undergo deployment from a compacted state to a deployed state, assembly comprising:
a sole ceiling;
a sole floor;
a sole space defined between the sole ceiling and the sole floor, the sole floor being movable with respect to the sole ceiling at least during deployment to expand and contract the sole space; and
a plurality of spacer element arrangeable upright in the sole space at least when the sole space is expanded, each spacer element having corresponding engagement features through which it is configured to be secured at an angle with a mating spacer element so as to support the sole ceiling above the sole floor at a predetermined distance at a deployed state of the sole.
23. The deployable shoe sole assembly of embodiment 22, wherein at least one of the spacer elements is flat.
24. The deployable shoe sole assembly of embodiment 22 or 23, wherein the engagement features comprise slits.
25. The deployable shoe sole assembly according to embodiment 24, wherein the slits of at least one spacer element are wider than a thickness of the respective mating spacer element configured to engage therewith.
26. The deployable shoe sole assembly of any one of embodiments 22 to 25, wherein each spacer element is connected to at least one of the sole ceiling or the sole floor.
27. The deployable shoe sole assembly of embodiment 26, wherein the connection is a hinge connection.
28. The deployable shoe sole assembly of any one of embodiments 22 to 27, wherein the plurality of spacer elements comprises more than three spacer elements arranged in a crisscross fashion.
29. The deployable shoe sole assembly of any one of embodiments 22 to 28, wherein the spacer elements are made of a rigid or semi-rigid material.
30. The deployable shoe sole assembly of any one of embodiments 22 to 29, wherein the spacer elements have different sizes to provide varying predetermined distances between the sole ceiling and the sole floor when secured in the sole space.
31. The deployable shoe sole assembly according to any one of one of embodiments 22 to 30, wherein each spacer element comprises a sheet material capable of flexing when secured in the sole space.
32. The deployable shoe sole assembly according to embodiment 31, wherein the sheet material has a thickness-to-length ratio between 1:20 and 1:40.
33. The deployable shoe sole assembly according to any one of embodiments 22 to 32, wherein in a compacted state of the sole assembly, the spacer elements are arranged substantially parallel to at least one of the sole ceiling and the sole floor.
34. The deployable shoe sole assembly according to any one of embodiments 22 to 33, wherein the engagement features of each spacer element comprise:
a first set of engagement features along a first edge portion; and a second set of engagement features along a second edge portion, wherein the first and second sets of engagement features are configured to engage with corresponding features of different mating spacer elements.
35. The deployable shoe sole assembly according to any one of embodiments 22 to 34, wherein:
each spacer element comprises a medial portion between its engagement features; and the medial portion is configured to flex in a controlled manner when the spacer elements are secured in the sole space under load.
36. The deployable shoe sole assembly according to embodiment 35, wherein mating spacer elements are configured to engage through their engaging features at a crossing angle of between 60 and 120 degrees.
37. The deployable shoe sole assembly according to any one of embodiments 22 to 36, wherein the spacer elements comprise surface textures for enhancing grip at intersection points.
38. A deployable shoe sole configured to undergo deployment from a compacted state to a deployed state, comprising:
a sole ceiling;
a wing structure hingedly connected to the sole ceiling, the wing structure comprising a plurality of wing elements hingedly connected to each other;
wherein at the deployed state, at least one wing element of the wing structure, being an upright extending wing element, extends upright relative to the sole ceiling, and
in the compacted state, the plurality of wing elements are arranged parallel each other.
39. The deployable shoe sole according to embodiment 38, comprising:
a first wing structure hingedly connected to a first side of the sole ceiling; and
a second wing structure hingedly connected to a second opposite side of the sole ceiling.
40. The deployable shoe sole according to Embodiment 39, wherein said sole ceiling has a central longitudinal axis, and each of said wing structures is symmetrically connected to the sole ceiling with respect to said central longitudinal axis.
41. The deployable shoe sole of any one of Embodiments 38 to 40, wherein the first and second wing structures are configured to interlock with each other through their respective wing elements most distal from their hinged connection to the sole ceiling.
42. The deployable shoe sole according to any one of Embodiments 38 to 41, wherein each wing element comprises abutment surfaces, and adjacent abutment surfaces of adjacent wing elements are configured to abut each other in the deployed state, so as to limit further hinged movement in a direction of deployment.
43. The deployable shoe sole according to embodiment 42, wherein the abutment surfaces are oriented at an angle between 60 and 120 degrees with respect to a plane defined by their respective wing element.
44. The deployable shoe sole according to any one of embodiments 38 to 43, wherein: said wing structure comprises at least three wing elements.
45. The deployable shoe sole according to any one of embodiments 38 to 44, wherein in the deployed state, at least one wing element being a ground engaging wing element is arranged substantially horizontally.
46. The deployable shoe sole according to Embodiment 45, wherein the ground engaging wing element is positioned between and hingedly connected to at least two adjacent wing elements at opposite sides thereof.
47. The deployable shoe sole according to any one of embodiments 38 to 46, wherein: the wing elements of each wing structure are sequentially connected to form a chain of wing elements; a first wing element in said chain being hingedly connected to the sole ceiling; and each subsequent wing element being hingedly connected to a preceding wing element in said chain.

48. The deployable shoe sole according to any one of embodiments 38 to 47, further comprising: a plurality of directionally resilient supporting elements incorporated in said upright extending wing element; wherein each directionally resilient supporting element is configured to compress under vertical load applied to the sole in a deployed state, and return to an original position when the load is removed.

49. The deployable shoe sole according to Embodiment 48, wherein: said directionally resilient supporting elements are configured to maintain lateral stability perpendicular to direction of resiliency.

50. The deployable shoe sole according to Embodiment 48 or 49, wherein each directionally resilient supporting element has an upper portion oriented at an angle with respect to a vertical, a lower portion oriented at an angle with respect to both the upper portion and the vertical, and a bend portion connecting therebetween.

51. The deployable shoe sole according to Embodiment 50, wherein the bend portion is reinforced compared to the upper and lower portions.

52. A deployable shoe sole assembly configured to undergo deployment from a compacted state to a deployed state, comprising:
a sole ceiling;
a sole floor movable with respect to the sole ceiling;
a sole space defined between the sole ceiling and the sole floor;
a plurality of hollow elements arrangeable in the sole space to support the sole ceiling above the sole floor at the deployed state of the sole, and nest one within the other outside the sole space in the compacted state of the sole.

53. The deployable shoe sole according to Embodiment 52, wherein the sole floor is movable to: expand the sole space for receiving the hollow elements, and contract the sole space for securing the hollow elements in the deployed state of the sole.

54. The deployable shoe sole according to Embodiment 53, wherein each hollow element comprises: a first end having a first cross-sectional area; and a second end having a second cross-sectional area larger than the first cross-sectional area.

55. The deployable shoe sole according to Embodiment 54, wherein each hollow element is skewed such that central axes of the first and second ends are offset relative to each other.

56. The deployable shoe sole according to any one of embodiments 52 to 55, wherein the sole space comprises: a plurality of receiving zones configured to accommodate the hollow elements in a predetermined arrangement in the deployed state.

57. The deployable shoe sole according to any one of embodiments 52 to 56, wherein each hollow element comprises mating guide features configured to couple with an alignment feature extending along a length of the sole.

58. The deployable shoe sole according to any one of embodiments 52 to 57, wherein: the sole space extends from a heel region to a forefoot region of the sole; and the hollow elements are arranged in series along said sole space.

59. The deployable shoe sole according to embodiment 58, wherein the coupling between the alignment feature and the mating guide features comprises a dove tail connection.

60. The deployable shoe sole according to Embodiment 59, wherein: hollow elements in the heel region have larger cross-sectional areas than hollow elements in the forefoot region.

61. The deployable shoe sole according to any one of embodiments 52 to 60, wherein each hollow element has a polygonal cross-sectional shape selected from: a parallelogram; a trapezoid; and a rectangle.

62. The deployable shoe sole according to any one of embodiments 52 to 61, wherein: the sole floor comprises a flexible portion enabling expansion of the sole space; and said flexible portion is foldable to achieve the storage state.

63. The deployable shoe sole according to any one of embodiments 52 to 62, further comprising: at least one rotatable insert having an open cross-sectional shape providing a gap; wherein in the deployed state, said rotatable insert is snugly fitted within at least one hollow element.

64. The deployable shoe sole according to Embodiment 63, wherein: rotation of the insert within the hollow element adjusts cushioning characteristics of the sole.

65. The deployable shoe sole according to any one of Embodiments 63 and 64, wherein the open cross-sectional shape is a C-shape having one gap.

66. The deployable shoe sole according to any one of Embodiments 63 and 64, wherein the open cross-sectional shape is a polygonal shape having a gap in one of its sides.

67. The deployable shoe sole according to any one of Embodiments 63 to 66, wherein: each hollow element has an internal surface; and each rotatable insert has an external surface configured to maintain frictional engagement with said internal surface during rotation.

68. The deployable shoe sole according to any one of Embodiments 63 to 67, wherein: the gap in the open cross-sectional shape defines two end portions; and rotation of the insert adjusts the orientation of said end portions relative to a vertical load direction.

69. The deployable shoe sole according to any one of Embodiments 63 to 68, wherein: multiple rotatable inserts are provided; each rotatable insert is sized to fit within a corresponding hollow element; and the rotatable inserts are configured to nest one within another in the storage state.

70. The deployable shoe sole according to any one of Embodiments 63 to 69, wherein: each rotatable insert comprises a through-hole alignable with the through-hole of its corresponding hollow element.

71. The deployable shoe sole according to Embodiment 70, wherein: the through-holes of the rotatable inserts and hollow elements are alignable in multiple rotational positions of the rotatable inserts.

72. The deployable shoe sole according to any one of embodiments 52 to 71, comprising: a locking mechanism configured to maintain the hollow elements in position in the deployed state.

73. The deployable shoe sole according to Embodiment 72, wherein the locking mechanism comprises: at least one through-hole extending through aligned hollow elements; and a locking rod insertable through said through-hole.

74. The deployable shoe sole according to any one of Embodiments 72 and 73, wherein: the locking rod is configured to extend through both the hollow elements and their corresponding rotatable inserts when aligned.

75. The deployable shoe sole according to any one of Embodiments 72 to 74, wherein: each through-hole in the rotatable inserts is positioned to maintain the gap orientation when aligned with the through-holes of the hollow elements.

76. A shoe sole assembly comprising:
a sole ceiling;
a sole floor movable with respect to the sole ceiling;
a sole space defined between the sole ceiling and the sole floor, said sole space comprising at least one receiving pocket;
at least one rotatable insert having an open cross-sectional shape providing a gap;
wherein said at least one rotatable insert is snugly fittable within said at least one receiving pocket.

77. The shoe sole assembly according to Embodiment 76, wherein: said at least one rotatable insert comprises a hollow body having an internal volume configured to support loads in the deployed state while enabling compression for storage.

78. The shoe sole assembly according to any one of embodiments 76 and 77, wherein said receiving pocket and rotatable insert comprise corresponding positioning features for maintaining discrete rotational positions.

79. The shoe sole assembly according to any one of embodiments 76 to 78, wherein: said gap defines a compression zone allowing controlled deformation of the hollow body in different orientations of the insert within the pocket.

80. The shoe sole assembly according to any one of embodiments 76 to 79, comprising: a plurality of said rotatable inserts arranged along a longitudinal axis of the sole.

81. The shoe sole assembly according to any one of embodiments 76 to 80, wherein: said hollow body has a polygonal external surface defining discrete positioning points relative to said receiving pocket.

82. The shoe sole assembly according to embodiment 81, wherein: said polygonal shape is octagonal.

83. The shoe sole assembly according to any one of embodiments 76 to 82, wherein said rotatable inserts are configured to nest within each other through temporary elastic deformation during insertion.

84. The shoe sole assembly according to any one of embodiments 76 to 83, wherein said pocket comprises at least one pocket through hole therein having an opening facing an interior thereof, and said at least one insert comprises a plurality of insert through holes sequentially extending from an outer surface of the insert along the circumference thereof, each alignable with the pocket through hole, and wherein said assembly further comprises a locking rod insertable through both the pocket through hole and the insert through hole to maintain the insert at a desired orientation.

85. The shoe sole assembly according to any one of Embodiments 81 to 84, wherein said pocket being collapsible when the insert is not received therein, and wherein said locking rod further prevents said insert from being removed from said pocket, thereby maintaining the pocket in a deployed, non collapsed, configuration.

86. The shoe sole assembly according any one of embodiments 76 to 85, wherein the rotatable insert is manufactured from a sheet material configured to temporarily deform under load and return to its original shape.

87. The shoe sole assembly according to embodiment 86, wherein the rotatable inserts have gradually increasing diameters from a forefoot region to a heel region of the sole.

88. The shoe sole assembly according to embodiment 87, wherein orientation of the gap in an uppermost or lowermost position provides maximum compression response under vertical load.

89. A deployable shoe sole assembly comprising:
a sole ceiling;
an array of support elements extending from the sole ceiling;
wherein adjacent support elements define channels therebetween;
and the deployable shoe sole is configurable between: a deployed state in which the support elements are arranged upright and the channels, and a rolled state in which the support elements are arranged along a curved path.

90. The deployable shoe sole assembly according to Embodiment 89, wherein each support element comprises first and second inclined surfaces; and a first inclined surface of each support element faces a second inclined surface of an adjacent support element to define said channels.

91. The deployable shoe sole assembly according to Embodiment 90, wherein each channel has a first maximal width in the deployed state and a second maximal width in the rolled state.

92. The deployable shoe sole assembly according to Embodiment 91, wherein the second maximal width is smaller than the first maximal width.

93. The deployable shoe sole assembly according to any one of Embodiments 90 to 92, wherein in the rolled state, the inclined surfaces of adjacent support elements abut each other.

94. The deployable shoe sole assembly according to any one of Embodiments 89 to 93, wherein support elements in a heel region of the sole have greater height than support elements in a forefoot region.

95. The deployable shoe sole assembly according to any one of Embodiments 89 to 94, wherein support elements in different regions of the sole have different base surface heights to provide varying pressure distribution.

96. The deployable shoe sole assembly according to any one of Embodiments 89 to 95, wherein said support elements comprise geometric features configured to guide the sole along a predetermined rolling path during transition between states.

97. The deployable shoe sole assembly according to any one of Embodiments 89 to 96, wherein said support elements have progressively varying incline angles along a longitudinal axis of the sole.

98. The deployable shoe sole assembly according to any one of Embodiments 89 to 97, wherein the support elements are configured to maintain their geometric relationships during sequential rolling transformation.

99. The deployable shoe sole assembly according to any one of Embodiments 89 to 98, wherein each support element is connected to the sole ceiling through a living hinge.

100. The deployable shoe sole assembly according to embodiment 90, wherein the inclined surfaces form an angle between 30 and 60 degrees with vertical in the deployed state.

101. The deployable shoe sole assembly according to any one of Embodiments 89 to 100, wherein each support element comprises a base surface configured for ground contact.

102. A deployable shoe sole assembly comprising:

a deployable sole configurable between a deployed state and a compacted state; and a locking member; wherein said locking member is configured to selectively maintain the deployable sole in the deployed state.

103. The deployable shoe sole assembly according to Embodiment 102, wherein: said deployable sole comprises a receiving arrangement configured to engage with the locking member.

104. The deployable shoe sole assembly according to Embodiment 103, wherein: said receiving arrangement comprises a series of aligned holes; and said locking member comprises a rod portion insertable through said series of aligned holes.

105. The deployable shoe sole assembly according to embodiment 104, wherein the rod portion comprises an edge selected from: a rimmed edge or a bent edge configured to engage with the rear portion of the deployable sole.

106. The deployable shoe sole assembly according to embodiment 104, wherein the rod portion comprises a finger-grippable portion at its rear part.

107. The deployable shoe sole assembly according to any one of Embodiments 104 to 106, wherein the rod portion comprises a circumferential slit near its edge configured for snug engagement with a last hole in the series.

108. The deployable shoe sole assembly according to any one of Embodiments 102 to 107, comprising: an accommodation mechanism formed at a rear portion of the deployable sole for engaging an edge portion of the locking member.

109. The deployable shoe sole assembly according to Embodiment 108, wherein: said accommodation mechanism comprises guide features configured to direct the locking member into engagement using single-handed operation.

110. The deployable shoe sole assembly according to Embodiment 109, wherein: said guide features comprise converging surfaces leading to a securing position.

111. The deployable shoe sole assembly according to any one of Embodiments 108 to 110, wherein: said accommodation mechanism comprises overlapping portions defining a securing zone that prevents accidental disengagement of the locking member.

112. The deployable shoe sole assembly according to Embodiment 111, wherein: said overlapping portions are configured to enable intentional release of the locking member through a predetermined release motion.

113. The deployable shoe sole assembly according to any one of Embodiments 104 to 107, wherein: said rod portion comprises positioning features engageable with said aligned holes to ensure proper insertion.

114. The deployable shoe sole assembly according to any one of Embodiments 104 to 113, wherein: said deployable sole comprises an array of support elements configured to arrange along a curved path in the compacted state; and said series of aligned holes extend through said support elements.

115. The deployable shoe sole assembly according to any one of Embodiments 104 to 114, wherein: said deployable sole comprises a plurality of hollow elements configured to nest one within another in the compacted state; and said series of aligned holes extend through said hollow elements when arranged in the deployed state.

116. The deployable shoe sole assembly according to Embodiment 115, wherein: at least one hollow element comprises a rotatable insert having an open cross-sectional shape; and said series of aligned holes extend through both said hollow element and said rotatable insert.

BRIEF DESCRIPTION OF THE DRAWINGS

Various aspects of the disclosed embodiments are illustrated schematically in the accompanying figures.

DETAILED DESCRIPTION OF THE DRAWINGS

The present invention relates to deployable shoe structures that address the need for compacting a shoe during shipping, storage, or in between uses. Throughout this description, deployment sequences are shown in reverse order (i.e., as compacting sequences) to facilitate easier comprehension for the reader. However, it should be appreciated that some embodiments of the presently disclosed subject matter may incorporate only a deployment function without a compacting capability, e.g., shipping in compacted state and deployment at the destination, while other embodiments enable both deployment and compacting functionality.

Figure 7:
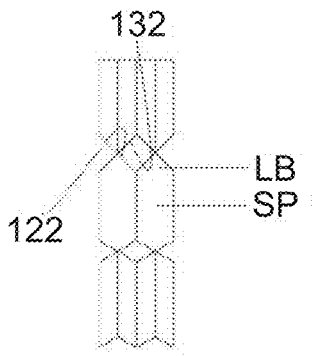
FIGS. 7 to 9 show a transition in close view of two structural elements of the sole of FIG. 2 between compacted and deployed states.
Figure 8:
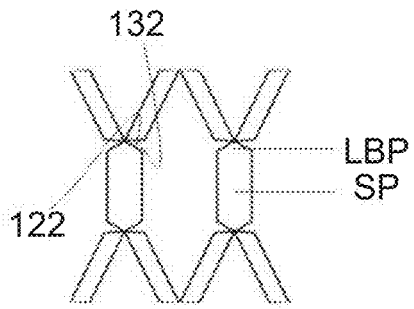

Referring to FIGS. 1 to 6, a deployable shoe 10 is shown with a deployable shoe sole 100 configured to undergo deployment from a compacted state to a deployed state. The deployable sole 100 comprises a deployable structure including at least a first structural element 120 and a second structural element 130 hingedly connected to one another at a connection point 145. This hinged connection enables movement between the first and second structural elements at least in a deployment direction marked with an arrow in FIG. 4. The first structural element 120, as seen in FIGS. 7 and 8, includes a first abutment surface 122, while the second structural element 130 includes a second abutment surface 132. The abutment surfaces are congruent and abut each other in the deployed state of the sole, so as to limit further hinged movement in the deployment direction.

Figure 9:
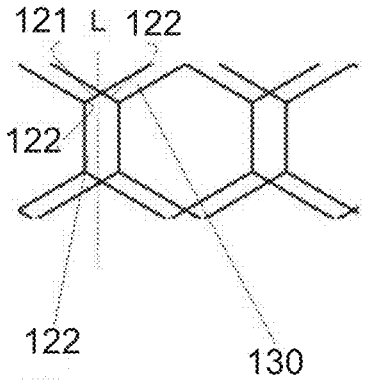

Attention is now drawn towards FIGS. 7 to 9. In a compacted state of the deployable shoe sole 100, shown in FIG. 7, the first and second abutment surfaces 122, 132 are separated from one another, forming an angle therebetween, and allowing the structure to achieve a reduced volume suitable for storage or transport. As can be seen in FIG. 7, this angle between the abutment surfaces in the compacted state is greater than 30 degrees, and in some configurations can even exceed 135 degrees. In contrast, in a deployed state shown in FIG. 9, the abutment surfaces 122, 132 come into contact with each other at an angle of 0 degrees, limiting further hinged movement between the first and second structural elements 120, 130 in the deployment direction and thereby providing structural stability to the deployable sole.

Geometrically locking structural elements such as elements 140, 150 can be incorporated in the structure to further enhance stability in the deployed state. These elements are particularly effective when implemented at the topmost and bottommost portions of the sole, where they can constitute a flat sole floor and/or a flat sole ceiling. During deployment, these elements rotate to achieve abutment when their abutment surfaces 141 and 151, are substantially parallel to the direction of expected load, EL so that appliance of said load effectively create the geometrical locking. In the present example, and typically when it comes to shoe soles, the direction of expected load is vertical, and the abutment surfaces of the geometrically locking structural elements is generally vertical as well in the deployed state. Particularly, the abutment surfaces rotate more than 60 degrees, and typically about 90 degrees, from their orientation in the compacted state to achieve their locking position in the deployed state, ensuring reliable locking while maintaining the ability to intentionally transition between states. This basic deployment mechanism forms the foundation for larger structural arrangements within the deployable shoe sole 100, as illustrated comprehensively in FIGS. 1-6. The deployable structure comprises multiple pairs of first and second structural elements 120, 130 arranged in an alternating pattern along the main longitudinal axis L of the sole. This arrangement creates a repeating pattern where each first structural element 120 is hingedly connected to at least two second structural elements 130, and each second structural element 130 is similarly connected to at least two first structural elements 120. The structural elements are arranged to create well-defined polygonal spaces between them. In the central portion of the sole, these spaces form complete polygons with n sides, e.g. hexagons in the specific embodiment exemplified herein. Where geometrically locking elements 140, 150 are present, e.g. at the topmost and bottommost portions, these spaces naturally form modified polygons with n−1 sides, e.g. pentagons, due to the specific arrangement requirements of the locking elements. The alternating pattern is organized into two primary rows: a first row extending along a first lateral side of the sole, and a second row extending along the opposite lateral side. These rows are symmetrically arranged about the longitudinal axis of the sole, as clearly visible in FIG. 1, ensuring uniform deployment characteristics and stable support across the width of the sole.

Each of the first and second structural elements 120, 130 comprises portions of rigid material from which their respective abutment surfaces 122, 132 are made, providing the necessary structural stability for effective load bearing in the deployed state. The deployable structure functions as a truss, with the first and second structural elements serving as truss elements. A flexible material connects the rigid portions of adjacent elements, facilitating the hinged connections between structural elements. This flexible material creates living hinges that enable smooth deployment motion while maintaining secure connection between elements.

Figure 1:
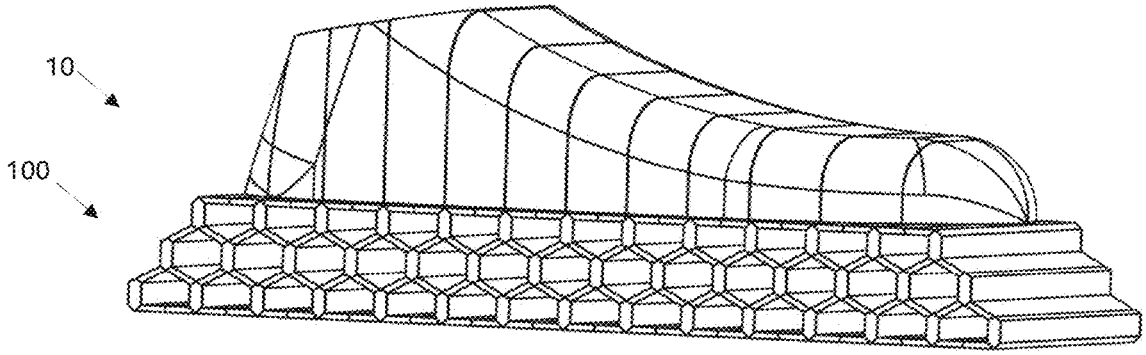
FIG. 1 is a schematic perspective view of one embodiment of the presently disclosed subject matter including a deployable sole and an upper of a deployable shoe.
Figure 2:
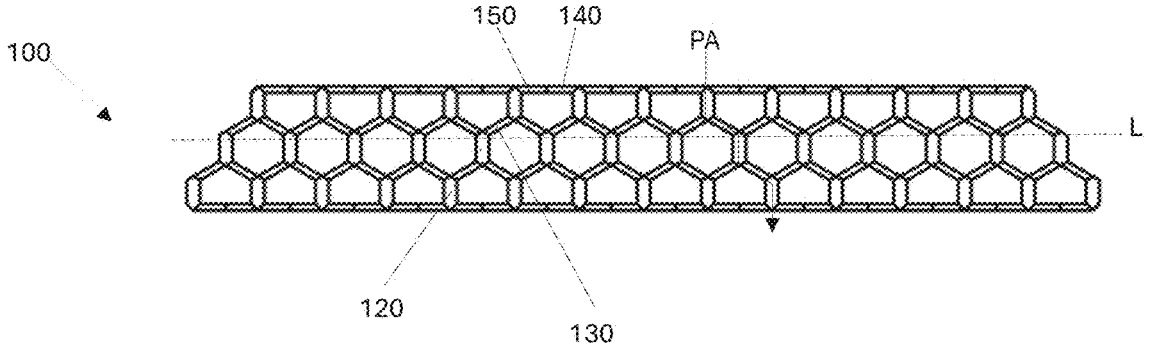
FIG. 2 shows the deployable sole of FIG. 1 in a side view, isolated from the upper.
Figure 3:
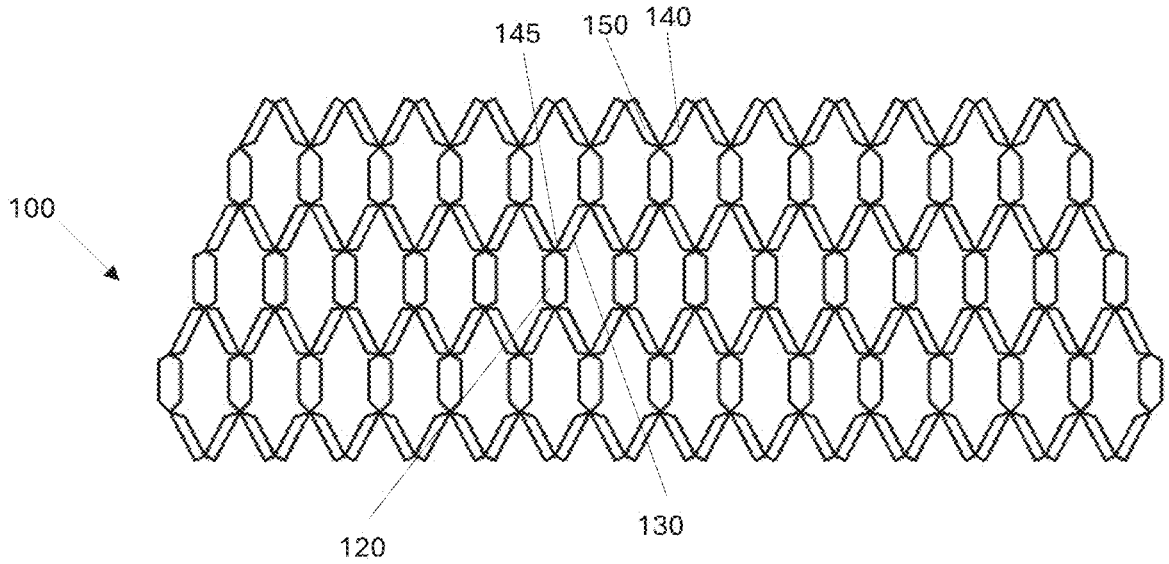
FIGS. 3 and 4 show, respectively, side and perspective views of the deployable sole of FIG. 2 in a transition state from a compacted to a deployed state.
Figure 4:
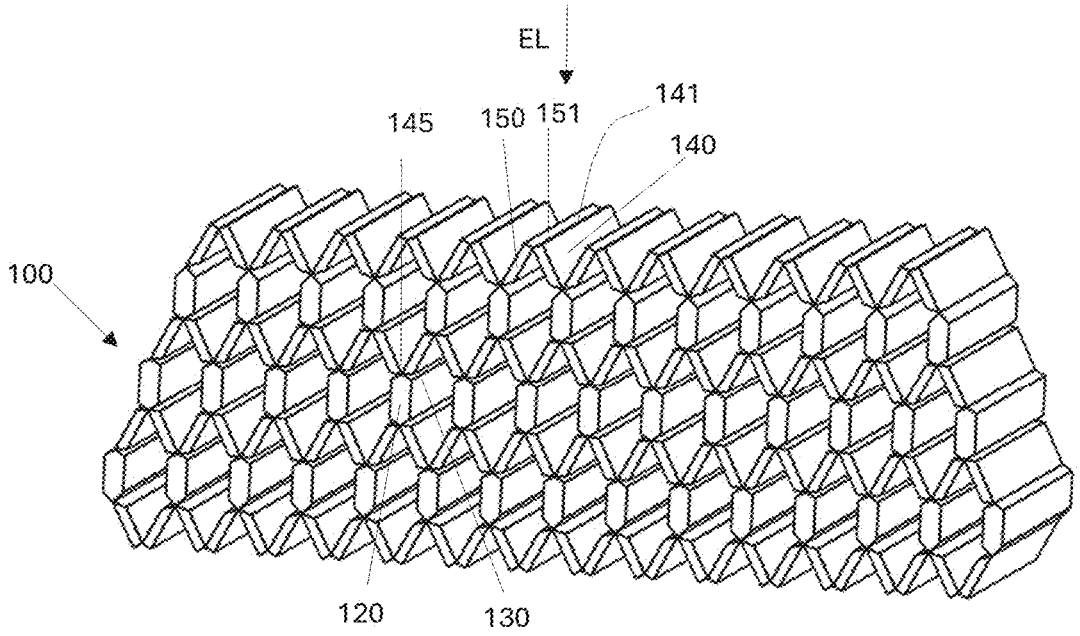
Figure 5:
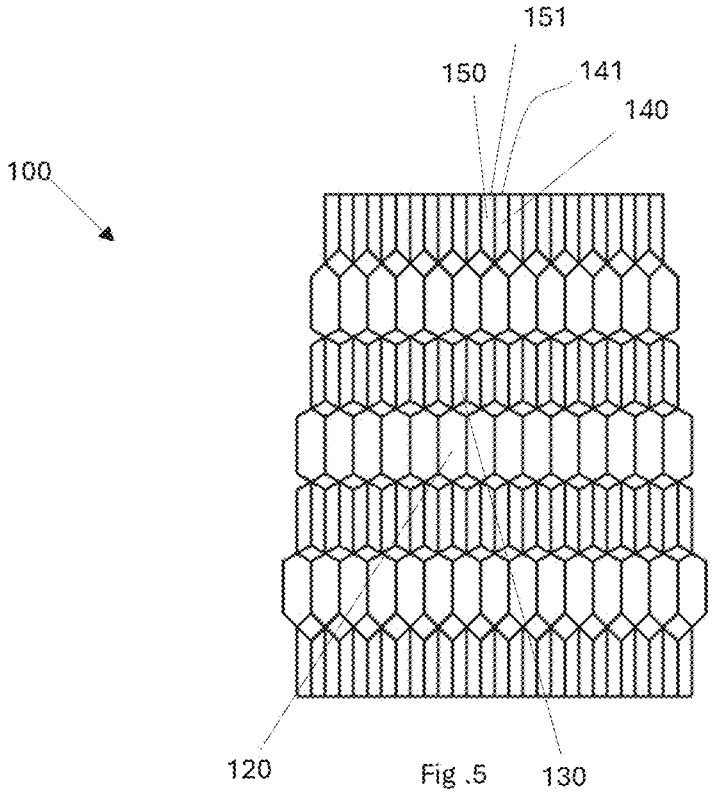
FIGS. 5 and 6 show, respectively, side and perspective views of the deployable sole of FIG. 2 in a compacted state.
Figure 6:
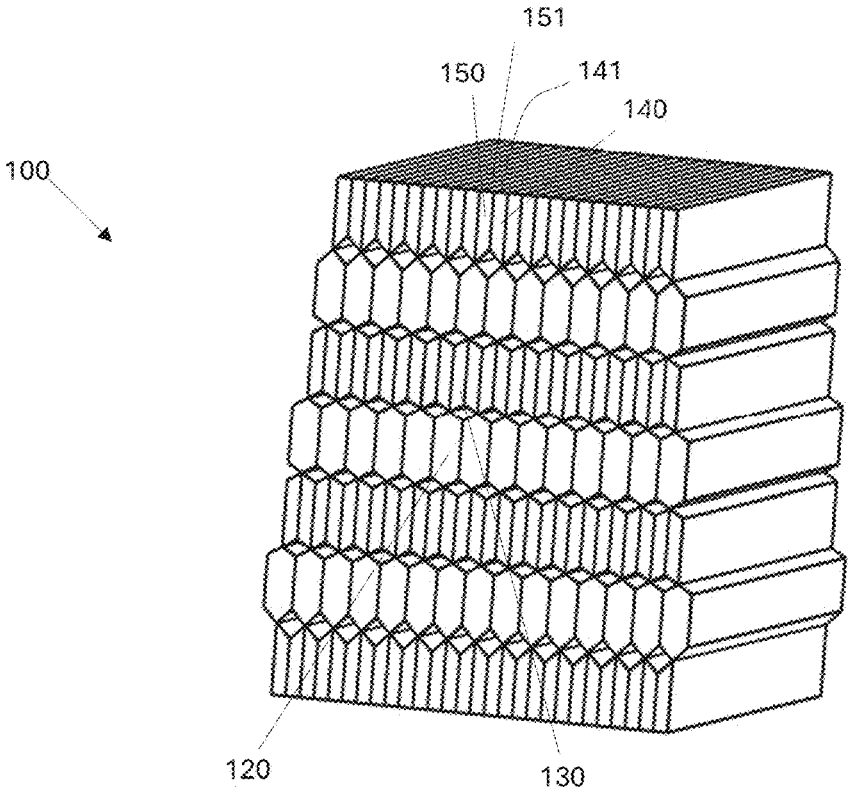

The polygonal arrangement of structural elements creates multiple parallel load-bearing paths extending from the heel region to the forefoot region of the sole. As best seen in FIG. 2, when the sole is in its deployed state, the abutting surfaces of adjacent structural elements align to form continuous load-bearing paths PA. These paths distribute loads applied to the sole during use, with the abutment surfaces serving as load transfer points between adjacent elements. As seen in FIGS. 7 and 8, each structural element comprises both a load-bearing portion LBP, which includes the abutment surface, and a support portion SP. As visible in FIGS. 7-9, the support portions of adjacent structural elements interlock in the deployed state, creating resistance to lateral displacement under load. The interlocking support portions engage at angles between 30 and 45 degrees relative to the load-bearing surfaces, optimizing resistance to both vertical and lateral forces.

The interconnected nature of the structural elements creates a coordinated deployment mechanism. When any structural element begins its transition between states, the geometric relationships between elements necessarily initiate corresponding movement in all connected elements. This coordinated movement culminates in simultaneous abutment of all abutment surfaces, ensuring uniform support across the sole structure. When pressure is applied to initiate deployment, the movement of each element creates a cascading effect that assists in deploying adjacent elements, and maintains relations between all elements such that no element can transition to a deployed or compacted state without the rest of the elements performing the same transition. This sequential deployment characteristic ensures smooth transition between states while preventing misalignment or binding. The structure can incorporate varying deployed thickness across different zones, enabling optimization for specific functional requirements, optionally resulting in different thicknesses across the sole length when deployed, accommodating natural foot biomechanics. For example, the heel region can achieve a greater deployed thickness for enhanced cushioning, while the forefoot region maintains flexibility through a different deployed thickness. To maintain the deployable structure in its deployed state, beyond the geometrical lock, a locking mechanism can be incorporated into the sole structure. The locking mechanism can engage when the sole reaches its fully deployed state, preventing unintended collapse during use while allowing intentional transition to the compacted state when desired. The entire deployable structure can be encased within a flexible outer covering, which protects the internal structural elements from environmental factors while accommodating the full range of deployment motion.

Figure 10:
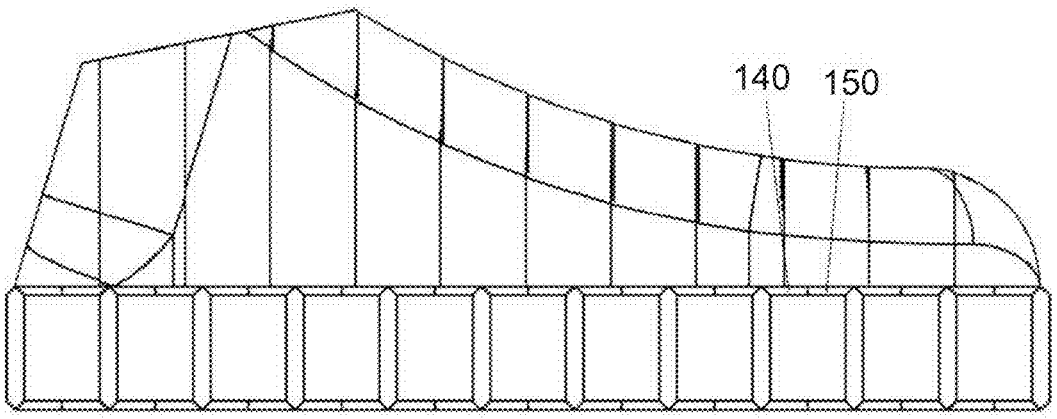
FIGS. 10 and 11 provide two other embodiments of a deployable shoe having the same upper as the deployable shoe of FIG. 1, yet with a different deployable sole relying on the same principles of shifting as the deployable sole of FIG. 2.
Figure 11:
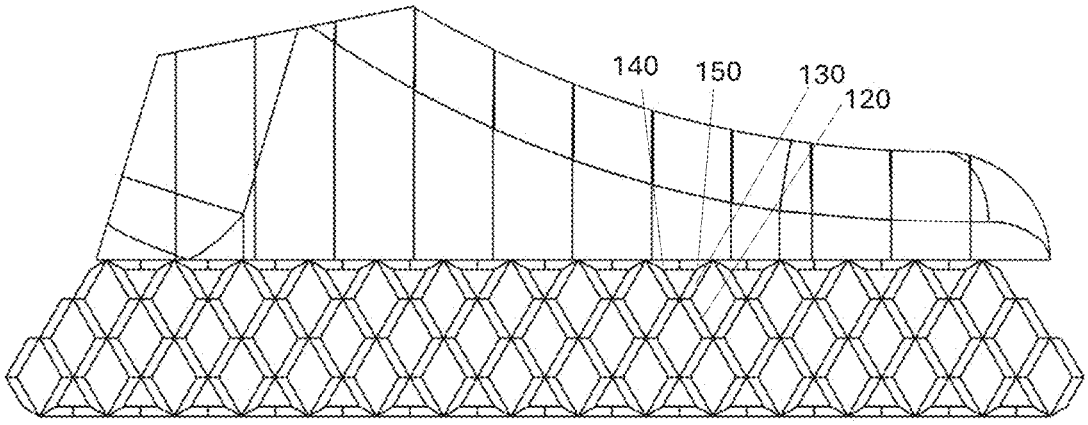

Alternative implementations of this basic structural arrangement are shown in FIGS. 10 and 11. These figures demonstrate how the same principles of shifting between compacted and deployed states can be achieved with different deployable sole configurations while maintaining the same upper as the deployable shoe of FIG. 1. In these alternative configurations, while the fundamental relationship between structural elements and their abutment surfaces remains consistent, the specific geometric arrangement and deployment characteristics vary to suit particular applications or performance requirements. These variations demonstrate the adaptability of the basic structural principles to different shoe/sole designs while maintaining the essential functionality of the deployable structure. According to a particular example shown herein, a structural element, such as element 120 in FIG. 9. can include an abutment surface such as 121, being angled to a first degree with respect to a central longitudinal axis L of the element, and have another abutment surface 122 spaced from the first abutment surface 121, configured to engage another second abutment surface 132 of a hingedly connected second structural element Another structural element can be of the kind of the second structural element 130, and can be a different structural element optionally having only such-angled abutment surfaces incorporated therein. In the particular example shown herein, the abutment surface 122' and the abutment surface 122 are disposed on opposite ends of the structural element 120 along the longitudinal axis L. According to an example of the presently disclosed subject matter, this deployable sole can be locked and secured in its deployed state by a locking mechanism, such as that that will be discussed hereinafter. In FIG. 11 there can be seen two kinds of structural elements, i.e., 140 and 150, being the geometrically locking structural elements, which kind can be seen in the uppermost and lowermost rows of the structure, and 130 and 120, being structurally supporting structural elements arranged in between the geometrically locking structural elements constituting the center portion of the sole.

According to another embodiment of the presently disclosed subject matter, the disclosed subject matter relates to a deployable shoe sole assembly incorporating intersecting spacer elements arranged in a crisscross configuration. Referring to FIGS. 12-15, the deployable shoe sole assembly 200 comprises a sole ceiling 210 and a sole floor 220, with a sole space 230 defined therebetween. The sole floor 220 is movable with respect to the sole ceiling 210 at least during deployment, thereby enabling modification of the volume of the sole space 230. Within the sole space 230, a plurality of spacer elements 240*a*, 240*b* (collectively referred to as "element(s) 240") are disposed, each having, respective engagement features 242*a*, 242*b* (collectively referred to as "engagement feature(s) 242"), configured to engage with corresponding features of the other spacer elements. The deployment sequence, shown in FIGS. 12 through 15, illustrates the transition of the sole from a deployed state to a compacted state. In the compacted state, the spacer elements 240 are arranged substantially parallel to either the sole ceiling 210 or the sole floor 220, thereby reducing the volume of the sole space 230. During deployment, the spacer elements 240 are positioned to engage one another at angles, thereby forming a supporting structure between the sole ceiling 210 and the sole floor 220.

Figure 16:
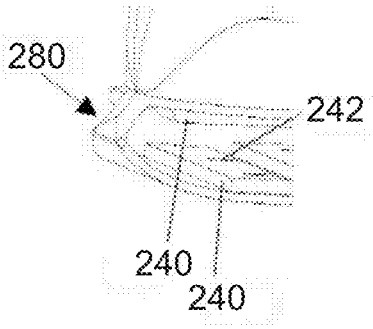
FIGS. 16 to 18 show sequential stages in close view of deployment of the configuration shown in FIG. 12.

Each spacer element 240 includes respective engagement features 242, such as slits, extending inward from edge portions of the spacer element. These engagement features 242 facilitate interlocking with corresponding features of adjacent spacer elements at intersection points 248. In some examples, only certain spacer elements may include engagement features, while in other examples, each spacer element may be equipped with at least one engagement feature. As depicted in FIG. 16, a first set of engagement features 242*a* is located along a first edge portion 244 of the spacer element, and a second set of engagement features 242*b* is located along a second edge portion 246. The engagement features 242 enable the spacer elements to form secure connections at the intersection points, thereby stabilizing the assembly when deployed.

The spacer elements 240 are formed from a sheet material possessing specific mechanical properties that allow for structural support while enabling controlled flexing. The material is sufficiently rigid to maintain the overall shape of each spacer element and to provide support between the sole ceiling 210 and the sole floor 220. Simultaneously, the material exhibits sufficient flexibility to enable controlled deformation, particularly bending, under applied loads. In the deployed configuration, the spacer elements 240 intersect at crossing angles ranging from 60 to 120 degrees, and typically at 90 degrees. These angles are critical to achieving both structural stability and flexibility in the assembly.

The engagement features 242, such as slits, are designed to accommodate the thickness of the respective mating spacer element. In some embodiments, the slits are formed with a width that may be slightly greater than the thickness of the engaging spacer element, at least along a portion of the slit height, to facilitate controlled bending during deployment and under load. This configuration contributes to the overall flexibility of the assembly while maintaining its structural integrity.

Figure 12:
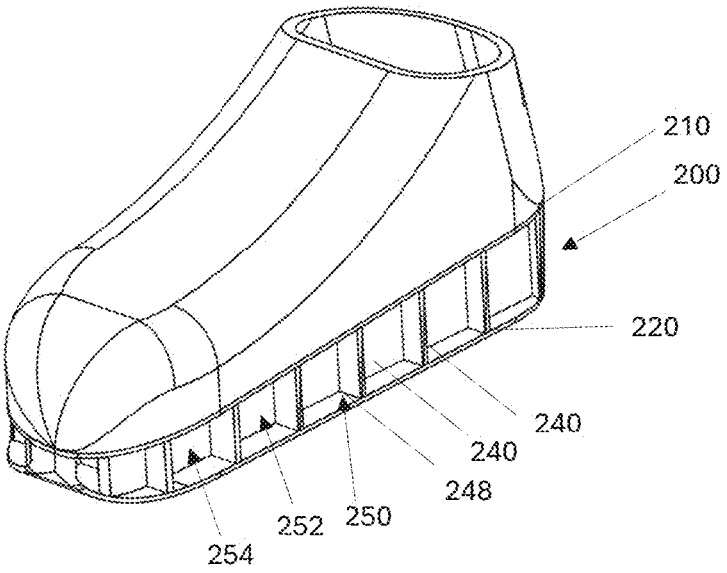
FIGS. 12 to 15 show a reverse deployment sequence in perspective views of a deployable shoe according to another embodiment of the presently disclosed subject matter, having a deployable sole incorporating a resilient shelf.
Figure 13:
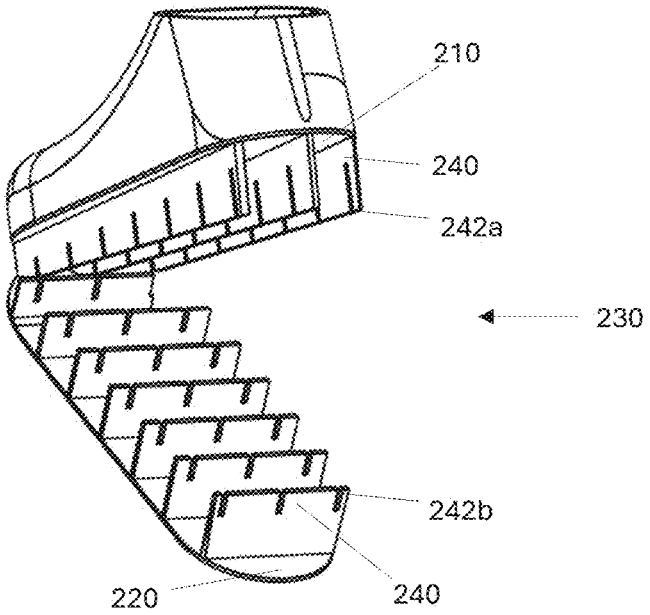
Figure 14:
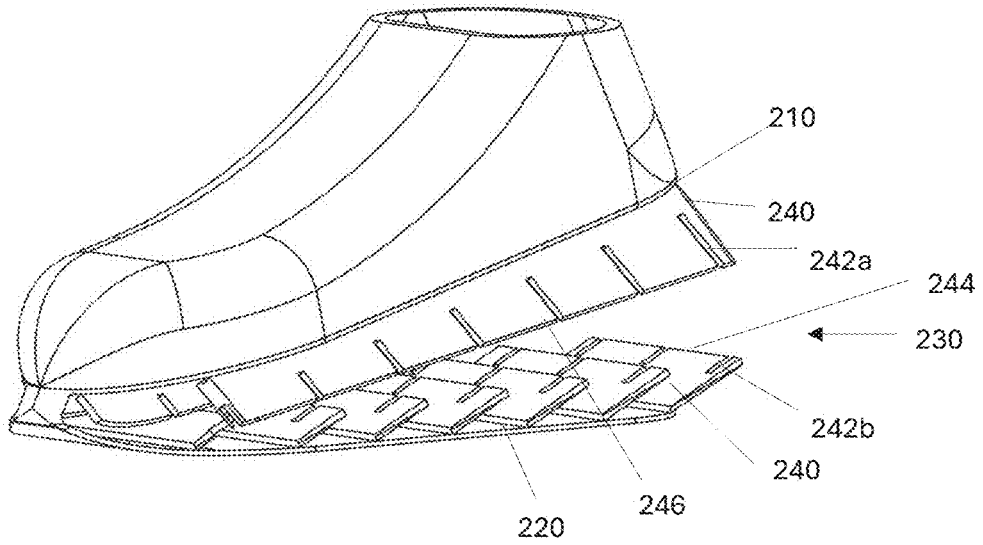
Figure 15:
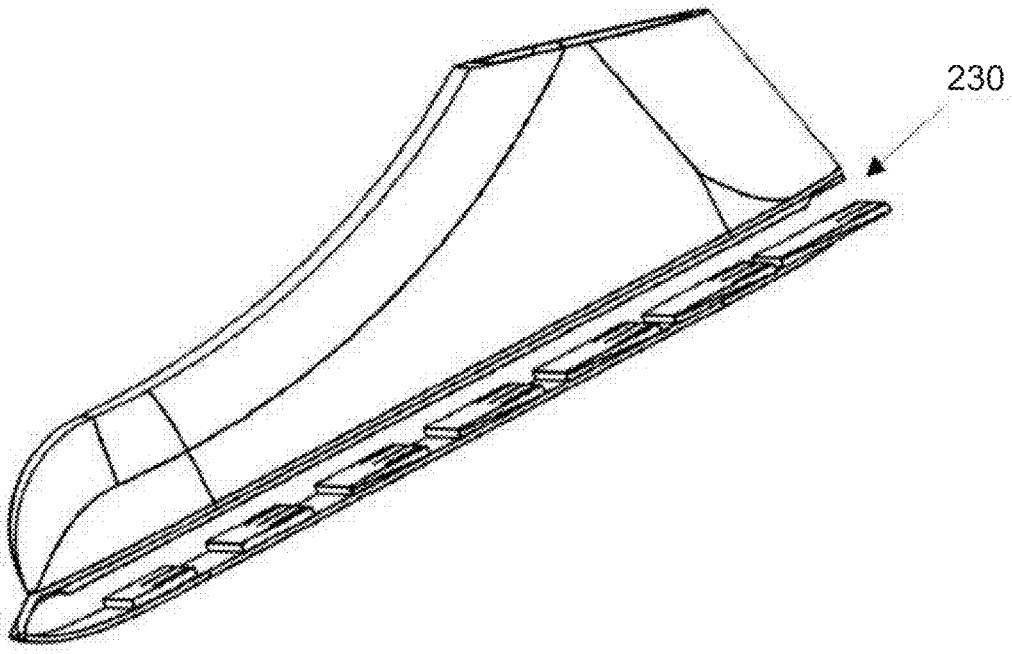

Attention is directed towards FIG. 12. The intersecting arrangement of the spacer elements 240 creates a network of support zones 250 and flex zones 252 within the sole space 230. The support zones 250 are centered around the intersection points 248 where spacer elements engage with one another, while the flex zones 252 are located in the medial portions 254 of the spacer elements between intersection points. This arrangement allows for controlled flexing under load while preserving the structural integrity of the assembly. As depicted in FIG. 12, the medial portion 254 of each spacer element 240 is configured to flex in a controlled manner when subjected to load, thereby enhancing the cushioning properties of the sole.

At least some of the spacer elements 240 are connected to the sole ceiling 210, while others are connected to the sole floor 220. This configuration creates a self-locking effect under vertical load, as the engagement of the spacer elements with one another and with the sole ceiling and floor prevents unintended displacement.

Figure 17:
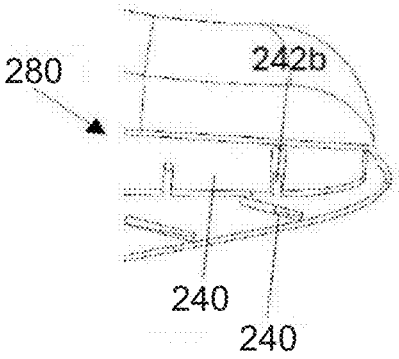
Figure 18:
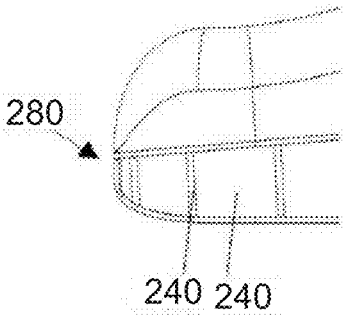

The deployment sequence, as shown in FIGS. 16 through 18, demonstrates the transition of the spacer elements from their compacted state to their deployed configuration. In the compacted state, the spacer elements 240 lie substantially flat and parallel to the sole ceiling 210 or the sole floor 220. As the sole floor 220 moves relative to the sole ceiling 210 to expand the sole space 230, the spacer elements 240, being connected to the sole ceiling and floor through a double hinge portion 280, can rotate and engage with one another through their engagement features 242.

The spacer elements 240 are secured in the sole space 230 through their engagement with other spacer elements and their connections to the sole ceiling 210 and the sole floor 220. A locking mechanism, not shown, may be employed to maintain the sole floor 220 in its contracted position relative to the sole ceiling 210, ensuring stable performance during use. Multiple sole spaces 230 may be incorporated within the sole assembly 200, with each sole space containing its own set of spacer elements 240. This configuration allows for the customization of support characteristics in different regions of the sole, such as variable shoe height, cushioning properties, arch support, or heel lift. These characteristics may be achieved by varying the size of the spacer elements 240 or by altering the engagement configurations.

The spacer elements 240 are particularly effective in providing graduated resistance to compression. Under initial load, the flex zones 252 deform elastically, offering cushioning. As the load increases, the intersecting geometry of the spacer elements generates progressively increasing resistance at the intersection points 248, thereby preventing collapse while maintaining comfort. The engagement of the spacer elements 240 under load creates a self-stabilizing effect, wherein increased load results in proportionally increased support without the need for additional mechanical components.

The relationship between the thickness of the spacer elements 240 and their length between intersection points 248 is critical to achieving the desired combination of support and flexibility. In some embodiments, a thickness-to-length ratio between 1:20 and 1:40 is employed to optimize these characteristics. Furthermore, the engagement features 242 may include surface textures or patterns to enhance the grip between intersecting elements, ensuring stable engagement during use. The edges of the engagement features 242 may be shaped to guide proper alignment during deployment, thereby facilitating assembly.

Alternative configurations of the spacer elements 240 may include variations in the placement of engagement features, additional reinforcement at intersection points 248, or modifications to the material properties to tailor the performance of the assembly. Such variations are within the scope of the present disclosure.

In accordance with yet another embodiment of the presently disclosed subject matter, a deployable shoe sole achieves both structural stability during use and efficient storage through a wing structure configuration. The deployable shoe sole incorporates wing elements that transition between a compacted state suitable for storage and a deployed state suitable for wearing. This arrangement enables the sole to maintain structural integrity and provide support during use while allowing significant volume reduction when not in use.

The wing structure configuration comprises a system of interconnected elements forming a stable support framework when deployed. The design provides multiple load paths that distribute forces effectively through the sole structure. Directionally resilient supporting elements integrated within the framework allow for controlled deformation under load while maintaining lateral stability, ensuring that the sole can respond to dynamic forces during walking or running.

Figure 19:
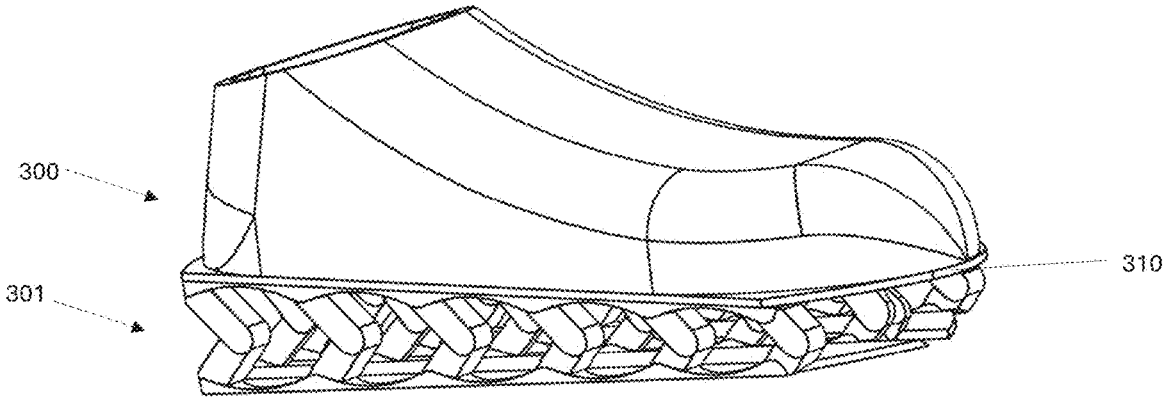
FIG. 19 shows schematic perspective view of a deployable shoe according to another embodiment of the presently disclosed subject matter in a deployed state, incorporating deployable sole in a deployable state having a folding wing structure with directionally resilient supporting elements.
Figure 20:
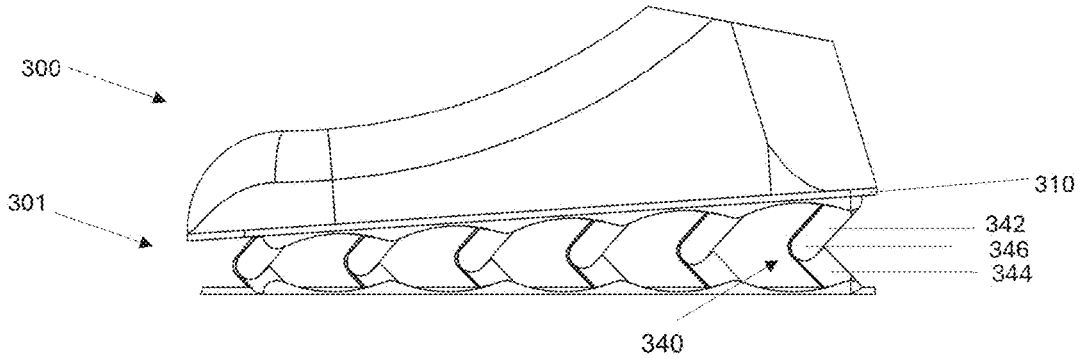
FIGS. 20 and 21 show, respectively, side views of the deployable shoe of FIG. 19, in relaxed and compressed states, where each directionally resilient supporting element is respectively compressed or relaxed.
Figure 21:
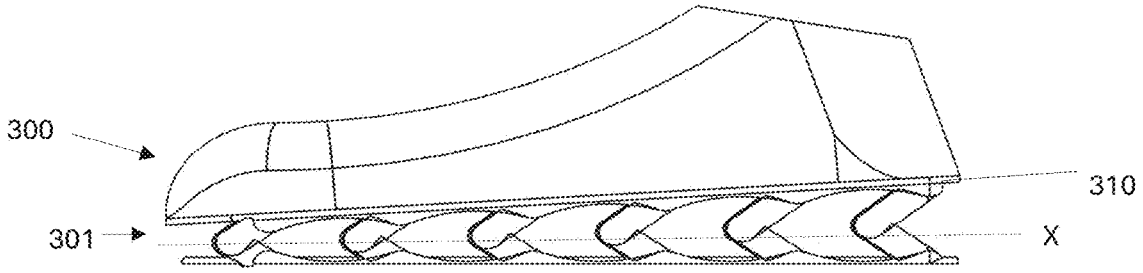

Referring to FIGS. 19-21, a deployable shoe 300 comprises a deployable sole 301 having a sole ceiling 310 that serves as a foundation for the wing structure arrangement. First and second lateral wing structures 320 and 330 are hingedly connected to opposite sides of the sole ceiling 310, and are symmetrically positioned relative to the central longitudinal axis X of the sole ceiling 310 to ensure balanced support and consistent deployment characteristics.

Figure 22:
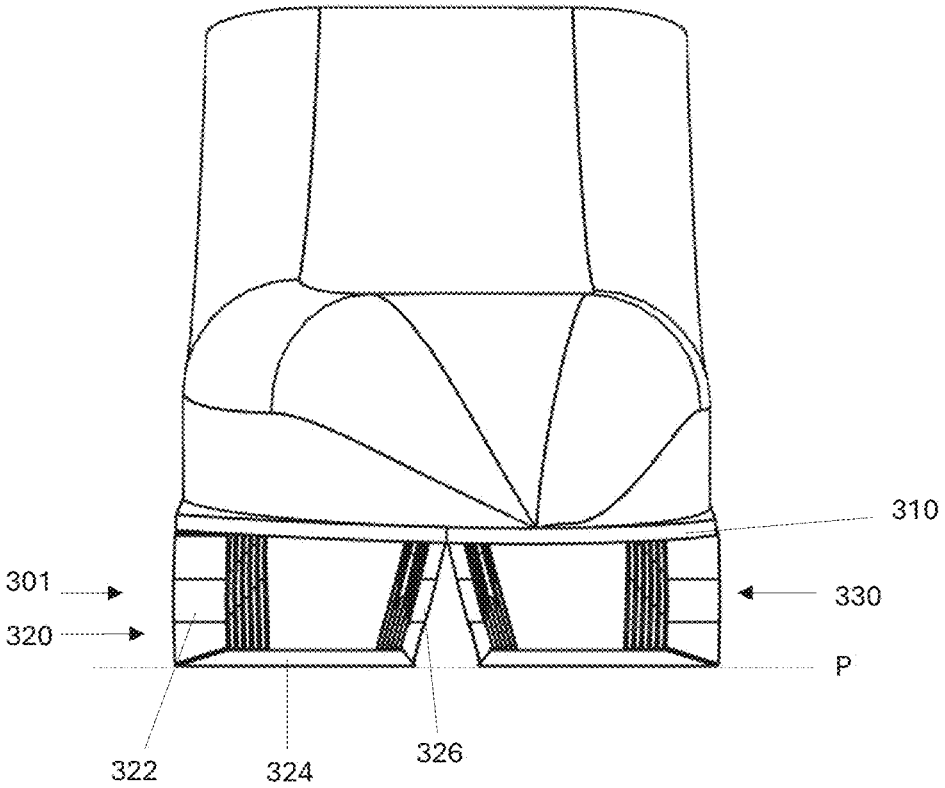
FIG. 22 shows a front view of the shoe of FIG. 19.

Each wing structure 320, 330 comprises a plurality of wing elements 322, 324, and 326, sequentially connected through hinged joints to form a continuous chain. These hinged connections allow controlled movement of the wing elements between the compacted state and deployed states while maintaining their structural relationships. In the deployed state, illustrated in FIG. 22, the wing elements assume specific orientations to create the functional geometry of the sole. One wing element, identified as the ground-engaging wing element 324, contacts the ground and establishes a ground plane P as a reference for the operation of the sole. Other wing elements, such as wing element 322, extend laterally from this ground plane to create the necessary three-dimensional structure for foot support.

Figure 23:
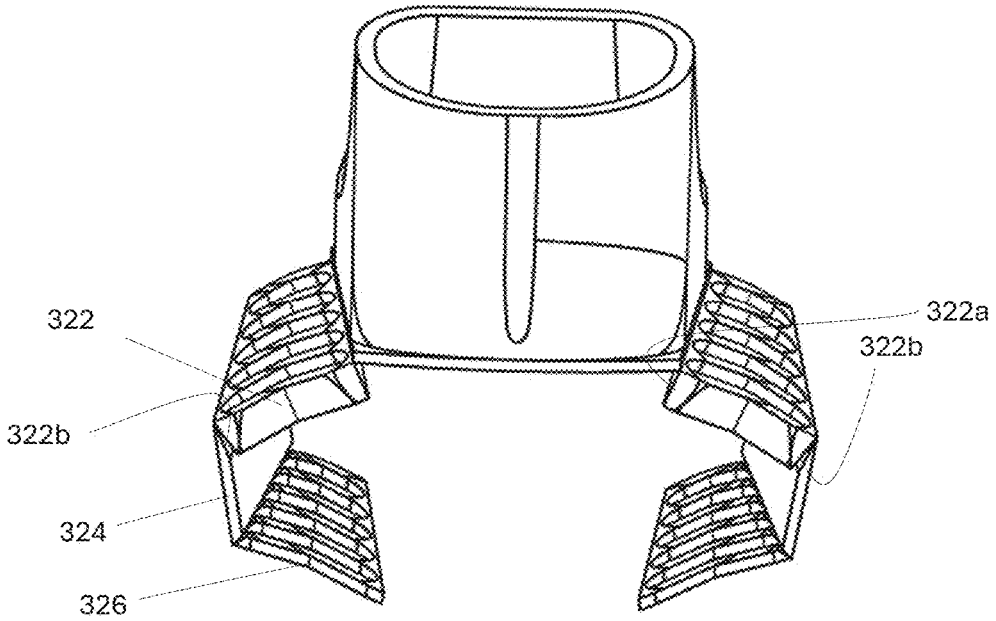
FIGS. 23 and 24 show a reverse deployment sequence of the deployable shoe with the deployable sole of FIG. 19, from a deployed state in FIG. 23 to a compacted state in FIG. 24.
Figure 24:
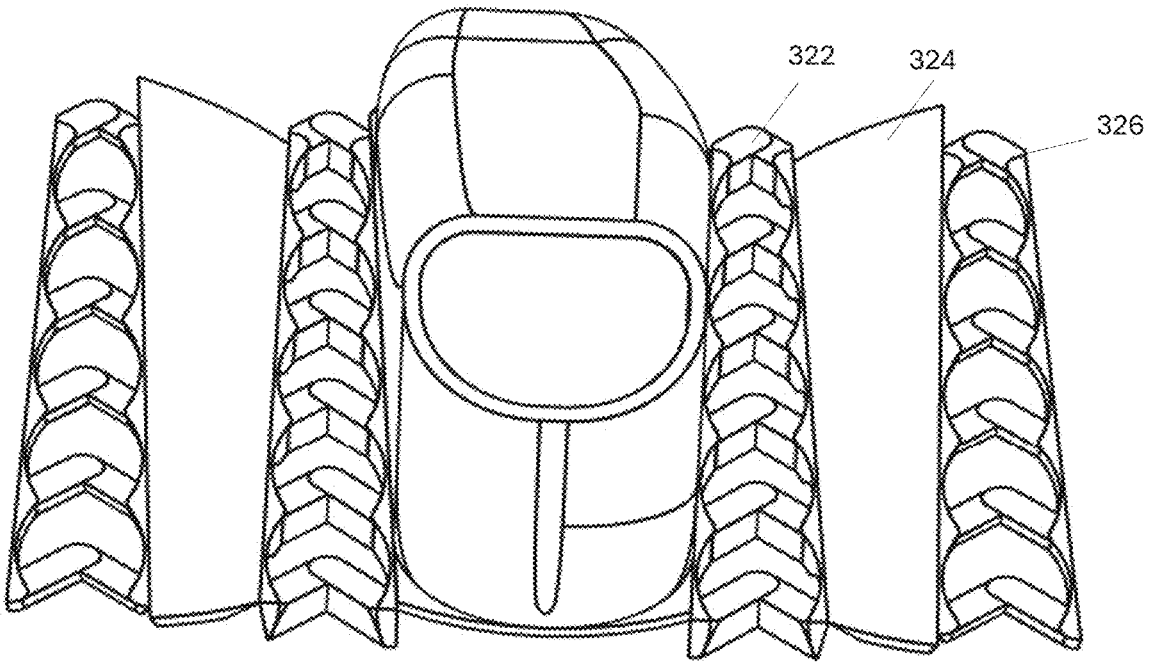
Figure 25:
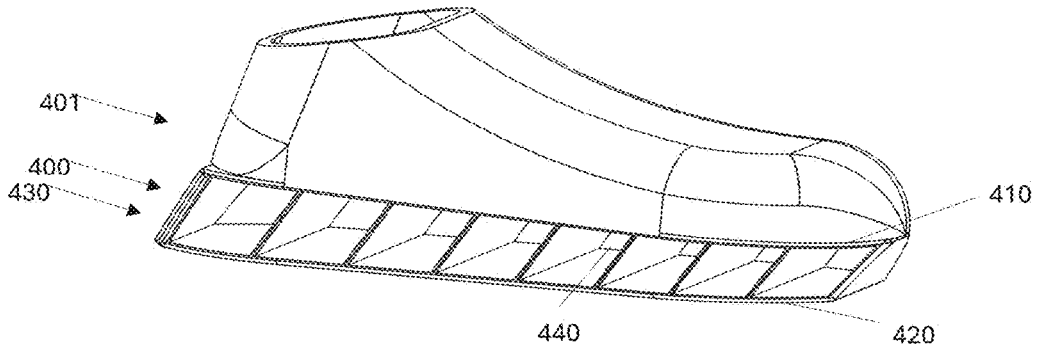
FIG. 25 provides a perspective view of another embodiment of a deployable shoe having a deployable sole incorporating a nested element configuration.

The transition between the compacted and deployed states is illustrated in FIGS. 23-24. During deployment, the wing elements 322, 324, and 326 of each of the two wing structures, pivot about their hinged connections in a coordinated sequence. The movement of each wing element influences adjacent elements through connecting supporting elements 340. This transition allows the wing elements to fold from a substantially two-dimensional configuration in the compacted state (FIG. 24) to an upright three-dimensional configuration in the deployed state (FIG. 23).

Each wing element comprises specific abutment surfaces configured to control deployment and provide structural stability. Load-bearing abutment surfaces 322*a* engage with corresponding surfaces of adjacent elements to support loads, while geometrically locking abutment surfaces 322*b*, oriented at angles between 60 and 120 degrees relative to the plane defined by the respective wing element, optimize deployment motion and stability.

The directionally resilient supporting elements 340 are integrated into the wing structure to enhance load management. Each directionally resilient supporting element comprises an upper portion 342 oriented at an angle relative to the vertical, a lower portion 344 oriented at angles relative to both the upper portion 342 and the vertical, and a bend portion 346 connecting the upper and lower portions. The bend portion 346 may be reinforced, either through increased material thickness or structural ribbing, to handle concentrated forces during compression while maintaining directional stability. The supporting elements 340 compress under vertical loads applied to the sole in the deployed state and return to their original positions when the load is removed, thereby providing for sole resilience and flexibility. Additionally, the supporting elements 340 resist lateral deformation, thereby providing lateral stability.

In the deployed state, the distal wing elements 326 of the two wing structures may interlock, creating a self-stabilizing arrangement under load. This interlocking may be achieved through specific geometric relationships between the elements and their abutment surfaces, ensuring secure engagement while allowing intentional transitions between states.

The compacted state, illustrated in FIG. 24, achieves maximum space efficiency by arranging the wing elements in a substantially flat configuration. In this state, the supporting elements 340 are aligned to minimize overall volume while maintaining their connections to adjacent elements. The wing structure configuration creates an integrated load management system through multiple parallel load transfer paths. Each load path begins at a ground contact point where the ground-engaging wing element 324 meets the ground plane P. Loads applied to the sole during walking or running are transmitted through the supporting elements 340 to the laterally extending wing elements and ultimately to the sole ceiling 310. The parallel arrangement of these load paths ensures even distribution of forces, providing redundancy and preventing any single path from bearing excessive force. Interaction between adjacent load paths forms a network of mutually supporting structures, allowing the sole to respond effectively to complex loading patterns encountered during gait cycles.

The wing elements may be manufactured from materials that balance structural rigidity with deployment flexibility. Hinged connections between elements, including living hinges, define precise axes of rotation, ensuring consistent deployment behavior while maintaining mechanical integrity through repeated cycles. Connection points between supporting elements and wing elements may be reinforced to manage stress concentrations that develop under load, preventing material delamination or mechanical failure.

When transitioning from the compacted state to the deployed state, the wing elements naturally move into their functional positions through guided geometric relationships. The interlocking relationship between the first and second wing structures provides tactile feedback to users, indicating proper deployment. This coordinated operation of wing structures, supporting elements, and their interfaces ensures reliable performance throughout the product's lifecycle.

The wing structure can be manufactured from a solid wing. Material is removed to create narrow paths. These paths connect the ceiling to the ground surfaces. Angling these paths creates directionally resilient structural elements. This design allows control over the bounciness of the sole eventually achieved.

Referring to FIGS. 25-28, the presently disclosed deployable shoe sole assembly introduces a nested element configuration that provides significant advantages in both storage efficiency and functional stability.

The nested element configuration achieves its dual functionality through the use of hollow elements designed to nest within a space within the sole and optionally one within another when removed from the sole structure. In the deployed state, the hollow elements are arranged to provide controlled support and resilient behavior, leveraging their hollow geometry. The hollow elements may also incorporate skewed configurations, allowing for extended resilience and controlled deformation under load, thereby enhancing both comfort and stability.

The deployable shoe 401 comprises a deployable sole 400 that includes a sole ceiling 410 and a movable sole floor 420. The sole ceiling 410 and sole floor 420 define a sole space 430 between them. The sole floor 420 is movable with respect to the sole ceiling 410, enabling the sole space 430 to expand for receiving hollow elements 440 or contract to secure them in position.

Figure 26:
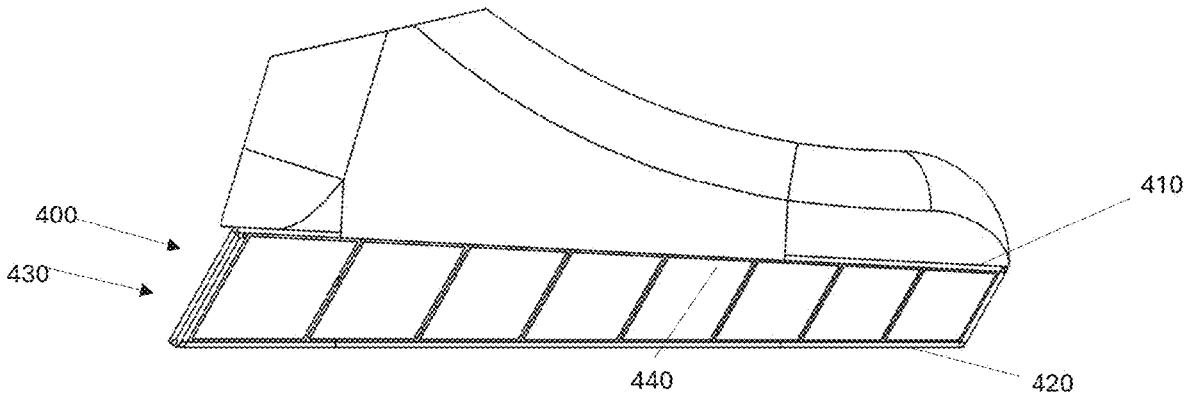
FIGS. 26-28 present a side view sequence showing a reverse deployment sequence of the nested elements of the configuration shown in FIG. 25, from a deployed configuration in FIG. 26 to a compacted configuration in FIG. 28.

Each hollow element 440 can feature a first end with a first cross-sectional area and a second end with a larger cross-sectional area, facilitating efficient nesting. This progressive sizing ensures that hollow elements of varying dimensions can nest compactly outside the sole space 430 in the compacted state. The hollow elements 440 in this embodiment feature a skewed configuration, such as a parallelogram, providing enhanced resilience and controlled deformation under vertical load while maintaining lateral stability in the deployed state. Preferably equidimensional throughout When positioned within the sole space 430, as shown in FIG. 26, the hollow elements 440 provide structural support between the sole ceiling 410 and sole floor 420. Their skewed configuration creates predetermined load paths, enabling controlled compression during use while preserving lateral stability. The interaction between adjacent hollow elements 440 creates a network of support structures that distributes forces effectively across the sole.

Figure 27:
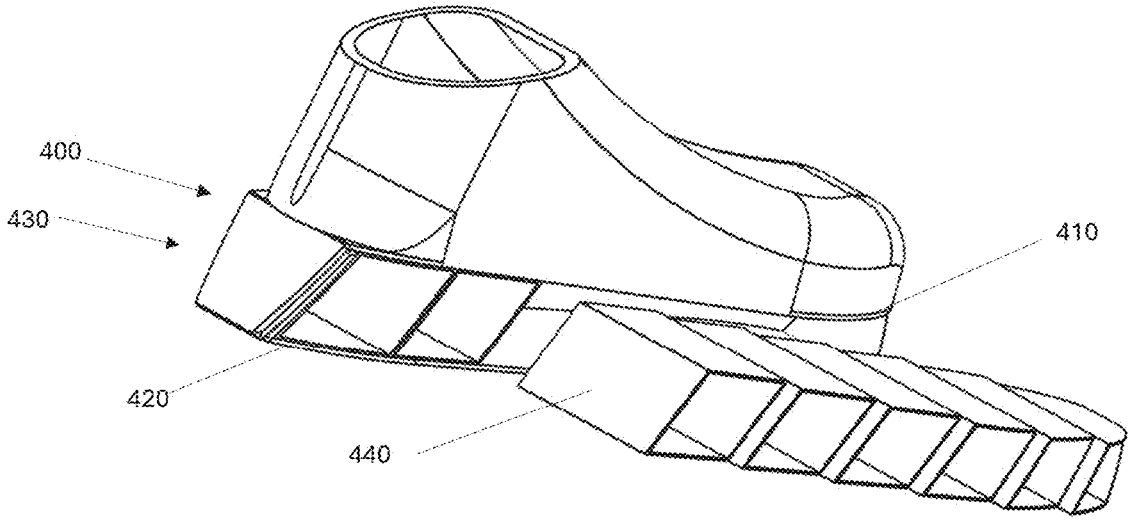

FIG. 27 illustrates the selective removal of hollow elements 440 from the sole 400, demonstrating the system's flexibility in allowing users to adjust the sole's support characteristics. Arear locking mechanism securing the hollow elements in position. This locking mechanism, if existing, must be disengaged to permit extraction of the hollow elements.

Figure 28:
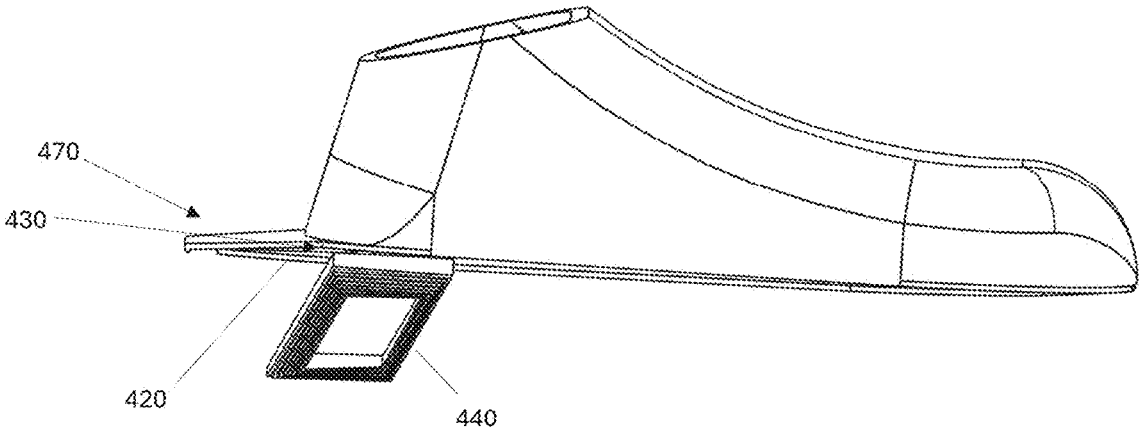

As depicted in FIG. 28, when removed, the hollow elements 440 can be nested compactly for storage. Each element receives the next smaller element with a close fit, significantly reducing volume while protecting the components during storage.

The skewed configuration of each element creates asymmetric load paths under vertical compression, ensuring balanced support throughout the sole space 430.

The hollow elements 440 may be arranged in series along the sole space 430, with elements in the heel region having larger cross-sectional areas than those in the forefoot region. This progressive sizing serves multiple purposes: it allows for varying support characteristics along the length of the sole and enables efficient nesting in the compacted state. Adjacent hollow elements 440 align to create continuous load paths, distributing forces encountered during walking or running.

The sole floor 420 incorporates a flexible portion 470 that facilitates expansion of the sole space 430. This flexible portion 470 can fold to achieve the compacted state, contributing to the overall volume reduction. Each hollow element 440 may include a gripping portion (not seen) accessible in the deployed state, enabling easy removal and reinsertion of the elements.

The hollow elements 440 can be secured in varying positions within the sole space 430, allowing the support characteristics of the sole to be customized. Under load, the skewed configuration of each hollow element 440 ensures controlled deformation while preventing collapse. The varying cross-sectional areas and wall thicknesses of the hollow elements provide progressive resistance to compression, with larger elements offering enhanced support in load-intensive regions in the rear of the shoe which support the heel.

Figure 29:
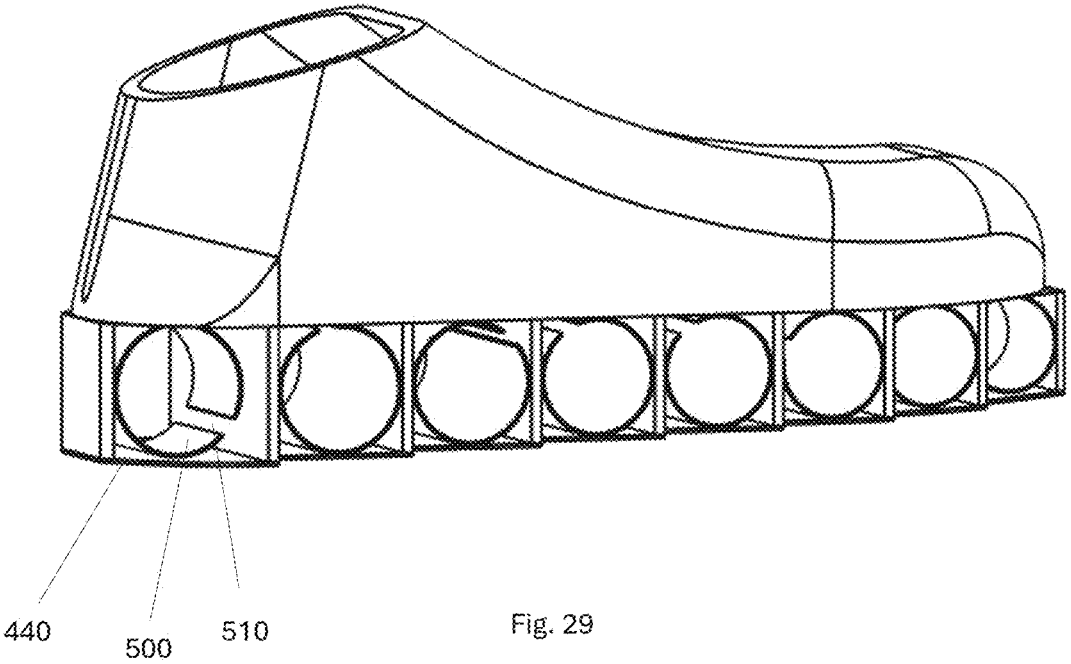
FIG. 29 shows a perspective view of deployable shoe according to yet another embodiment of the presently disclosed subject matter, having a deployable sole incorporating rotatable inserts having an open cylindrical shape, which may be located within the nested elements of FIG. 25, or within another collapsible structure, as the collapsible structure seen in this Figure.
Figure 30:
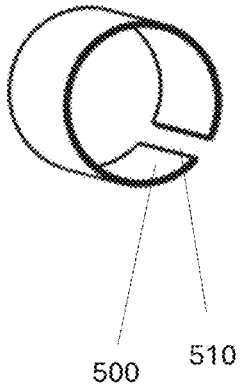
FIG. 30 shows in close a rotatable insert from FIG. 29.

According to FIGS. 29-30, another embodiment of the presently disclosed subject matter provides a deployable shoe sole incorporating rotatable inserts that enhance control over compression characteristics while maintaining efficient storage capabilities. The rotatable inserts can function independently within designated receiving pockets in the sole or in conjunction with hollow elements of the previously described embodiments, which may serve as receiving pockets. Each rotatable insert provides structural support and adjustable bounciness through its unique geometry. The open configuration of the insert enables controlled compression and rebound by rotation, allowing users to adjust these characteristics according to personal preference or activity requirements.

Referring to FIG. 30, a rotatable insert 500 comprises a hollow cylindrical body with an open circular cross-sectional shape forming a gap 510. The gap 510 enables the insert to compress under load and rebound when the load is removed, providing a bouncy response during use. The degree of bounciness is adjusted by rotating the insert to change the orientation of the gap 510 relative to applied loads. For instance, orienting the gap directly under the load direction maximizes compression response, while positioning the gap away from the primary load direction reduces the bouncy effect. When the primary load direction is vertical, positioning the gap at the uppermost or lowermost point optimizes compression. The inserts are configured to deform elastically under load, ensuring consistent performance over repeated cycles of compression and rebound.

Figure 31:
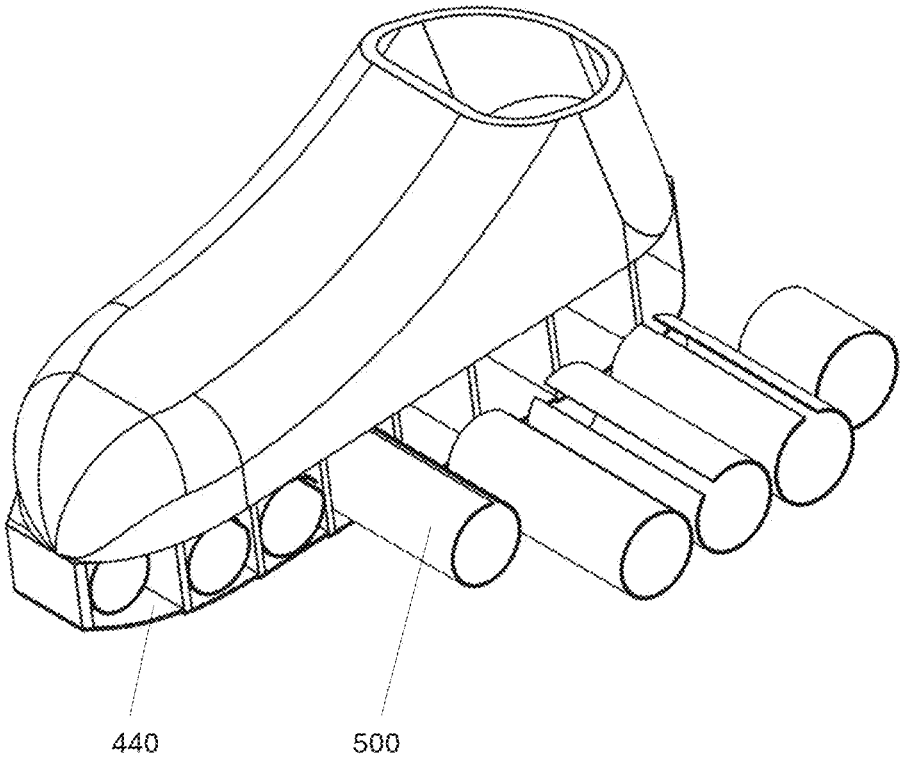
FIGS. 31 and 32 show a deployment process in reverse in which the inserts are removed, and then nested as the collapsible structure is at a collapsed state.
Figure 32:
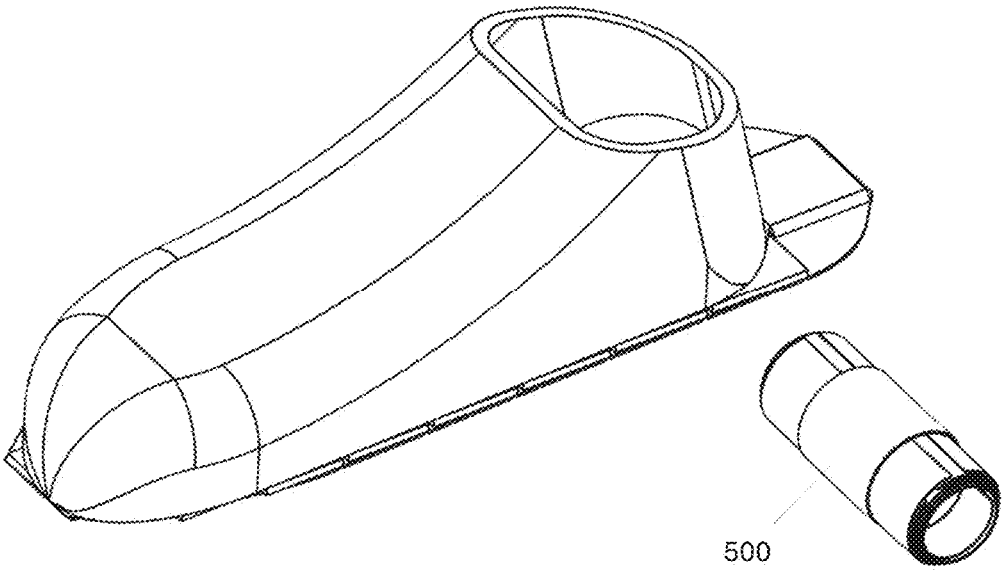

As illustrated in FIGS. 31 and 32, the rotatable inserts 500 are hollow and can nest within each other for compact storage when removed from the sole. This nesting is enabled by the elastic properties of the inserts, which allow one insert to expand slightly in diameter to accommodate another. In another example, nesting is achieved through a progressive sizing configuration, where the cross-sectional dimensions of the inserts gradually increase, enabling efficient stacking. For inserts with varying dimensions along their length, the corresponding receiving pockets in the sole are configured to accommodate these variations, ensuring a snug fit and secure placement during deployment.

The rotatable inserts may be made from a resilient sheet material capable of deforming temporarily under load and returning to its original shape. This material characteristic, combined with the open cross-sectional configuration, allows the insert to act as a spring element during use. The wall thickness of each insert is engineered to provide specific resistance to compression while preserving its ability to rebound effectively. The inserts may vary in both diameter and length to suit different regions of the sole, with larger diameters placed in the heel region to handle higher loads and smaller diameters in the forefoot region for greater flexibility. The length variations correspond to the natural shape of the foot, ensuring proper support across the sole.

The rotatable inserts can be positioned within various receiving pockets in the sole, and in one exemplary configuration, the hollow elements described in FIGS. 25-28 serve as these receiving pockets. In such cases, the hollow elements fulfill a dual purpose by providing the deployable structure of the sole and creating designated spaces for accommodating the rotatable inserts. This integration combines the storage efficiency of the hollow elements with the adjustable bounciness provided by the rotatable inserts. When the hollow elements are used as receiving pockets, their through-holes can align with corresponding through-holes in the rotatable inserts, forming a continuous passage. This arrangement supports the use of a locking member, such as a rod, to secure both the hollow elements and the inserts in their deployed positions while allowing rotational adjustment of the inserts before locking.

Figure 33:
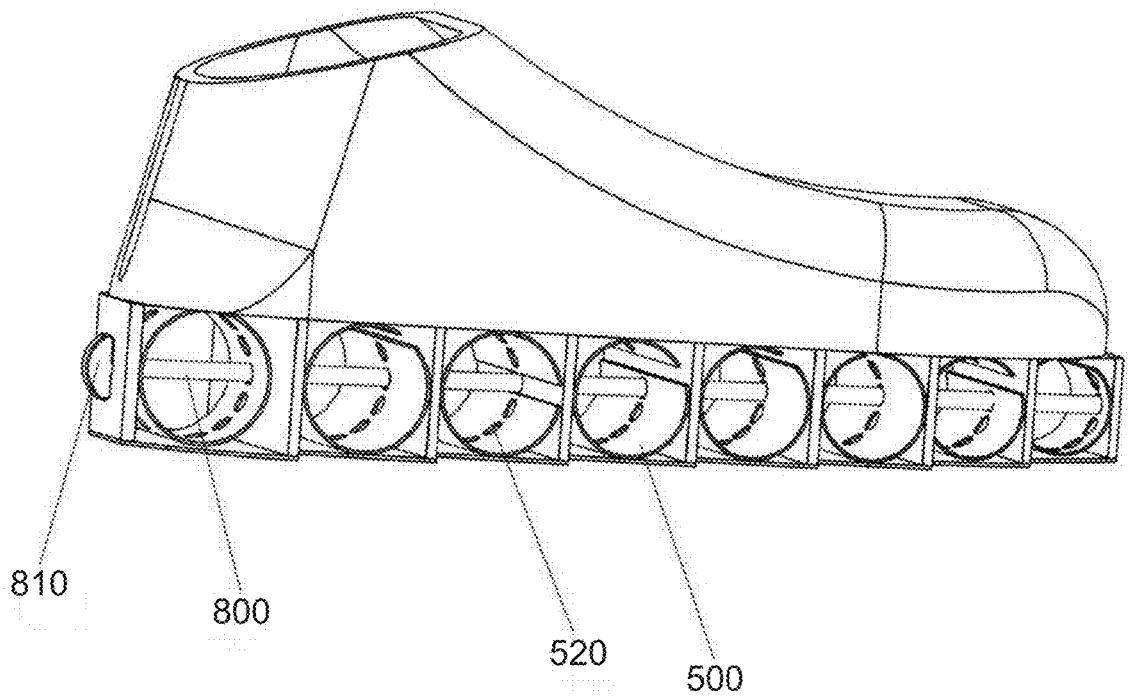
FIG. 33 shows a perspective view of a deployable shoe having a deployable sole similar to that of FIG. 29 however with a different type of inserts having a series of holes in them, the shoe also includes a locking member in the form of a rigid rod inserted through each configured to maintain the inserts in position and the sole in a deployed state.

FIG. 33 illustrates another embodiment of the presently disclosed subject matter, in which the inserts 500 are shown however with through holes 520 formed in them, allowing a locking member in the form of a locking rod 800 to pass therethrough and fix them in position their respective rotational positions, and in their respective pockets.

Figure 34:
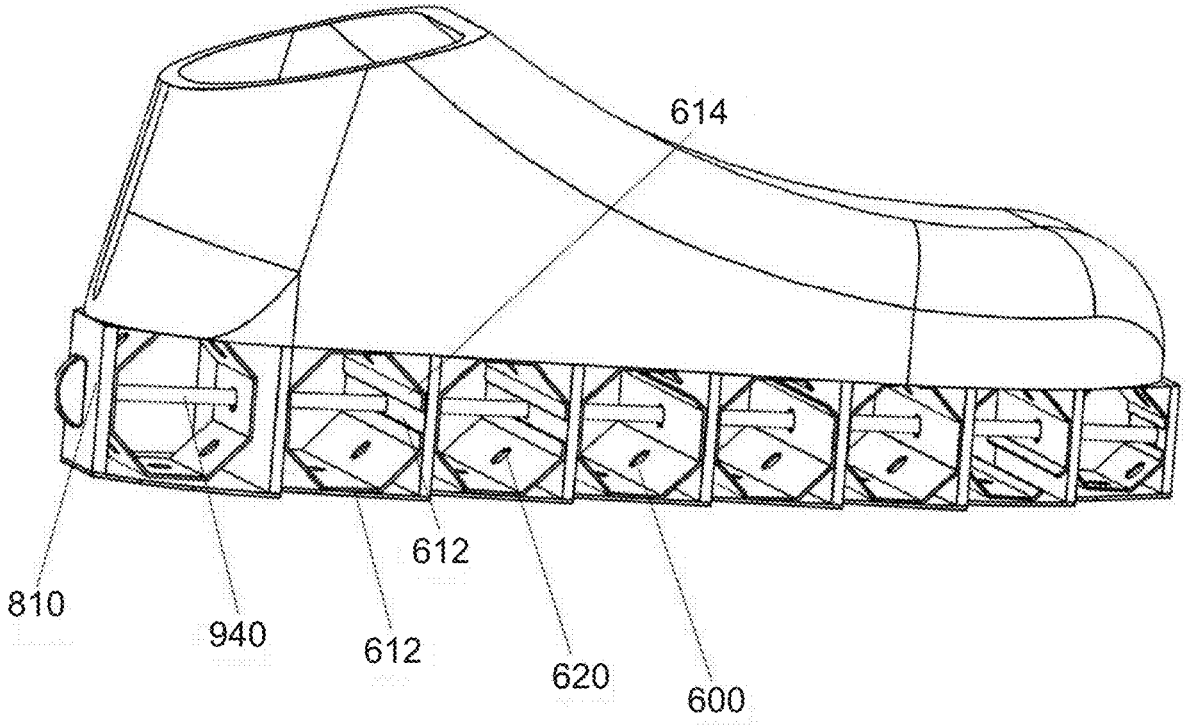
FIG. 34 shows a perspective view of a deployable shoe having a deployable sole similar to that of FIG. 33, however with shaped inserts, particularly an octagon cross sectioned inserts having one open side.
Figure 35:
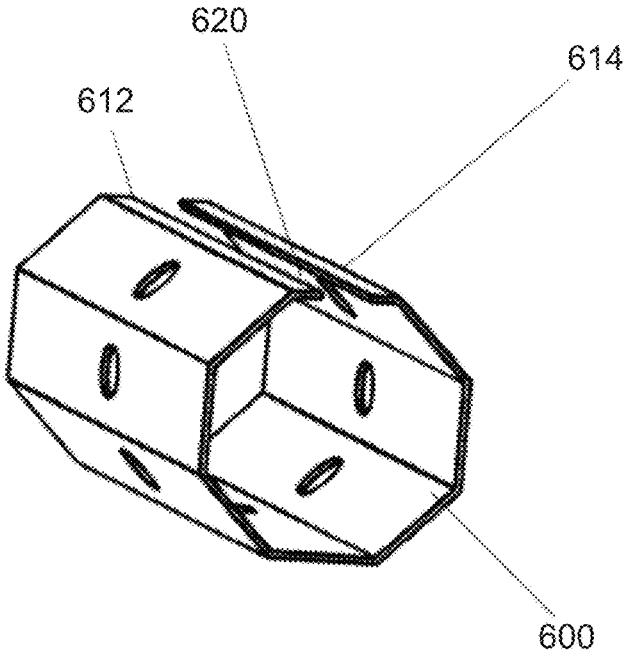
FIG. 35 a close-up view of the insert of FIG. 34.

As shown in FIGS. 34-35, another variation of the rotatable insert includes a polygonal cross-sectional shape, particularly an exemplary octagonal configuration. The polygonal insert 600 maintains the open cross-sectional design for bounciness while introducing discrete rotational positions through its geometric structure. Referring specifically to FIG. 35, the polygonal insert 600 comprises multiple walls defining its octagonal perimeter, with one wall including two portions 612 and 614 that form a gap 610. The gap 610 functions similarly to the cylindrical configuration, enabling controlled compression and rebound. The polygonal shape provides additional benefits, including increased stability and prevention of unintended rotation. Each wall of the polygonal insert 600 includes at least one through-hole 620, allowing the insert to be secured in different rotational positions within its receiving pocket. The orientation of the gap 610 relative to applied loads is adjusted by aligning the insert within the pocket, offering precise control over the compression characteristics of the sole.

The polygonal inserts are designed to engage with corresponding receiving pockets that match their shape, preventing unintended rotation and ensuring a secure fit. The discrete rotational positions are maintained through engagement between the flat surfaces and angles of the polygonal insert and the pocket walls. The through-holes 620 enable the use of a locking member to secure the insert and maintain its orientation during use.

The integration of rotatable inserts with the sole structure provides a flexible solution for customizing the sole's performance characteristics. The inserts can function independently or as part of a combined system with hollow elements, enabling users to tailor the compression response and adjust the sole's behavior to suit their needs. The ability to nest the inserts during storage further enhances the overall utility of the sole assembly by reducing its volume when not in use.

According to FIGS. 36-41, yet another embodiment of the presently disclosed subject matter provides a deployable shoe sole that achieves compact storage through a rolling transformation mechanism. This embodiment addresses the challenge of storage efficiency by incorporating a unique arrangement of support elements that transition between a deployed configuration, providing stable support, and a rolled configuration, achieving minimal storage volume. The rolling configuration is enabled by specially engineered support elements designed to facilitate controlled transformation while maintaining structural integrity throughout the process. Each support element incorporates specific geometric features that guide the rolling motion, ensuring stability in the deployed state and a smooth transition to the rolled state. This arrangement allows the sole to maintain its supportive characteristics when deployed while enabling a reliable and compact storage configuration.

Figure 36:
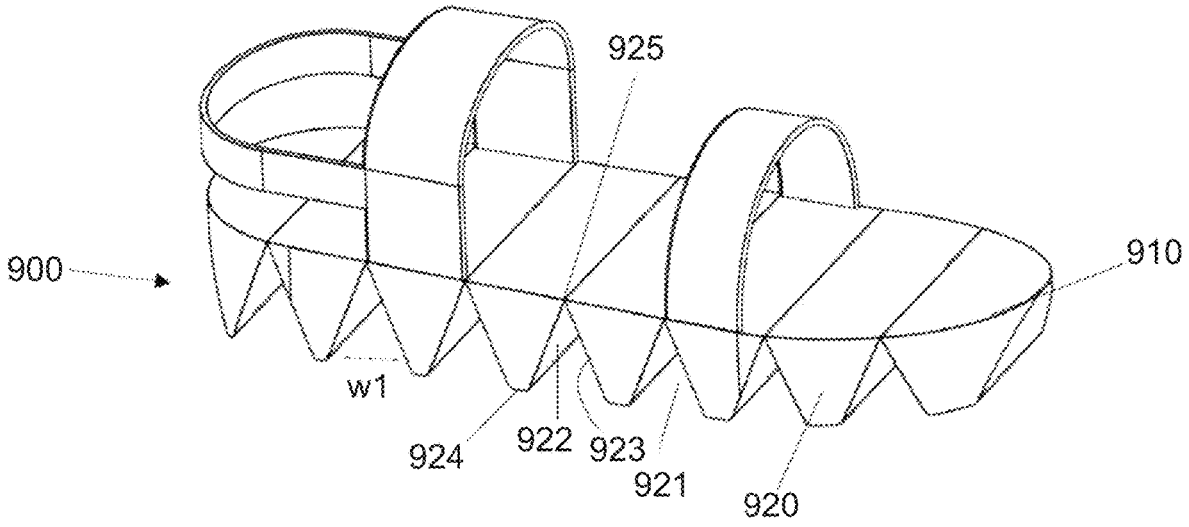
FIG. 36 shows a perspective view of yet another embodiment of the presently disclosed subject matter in which a deployable rolling shoe having a deployable rolling sole in a fully deployed state.
Figure 37:
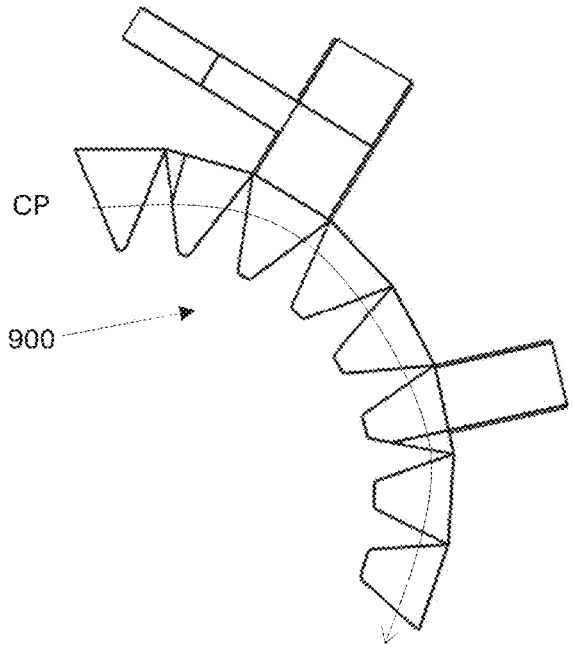
FIGS. 37 and 38 show, respectively, the rolling deployable shoe with the rolling deployable sole of FIG. 36, in a transition state between a deployed and compacted states, and in a fully compacted state.
Figure 38:
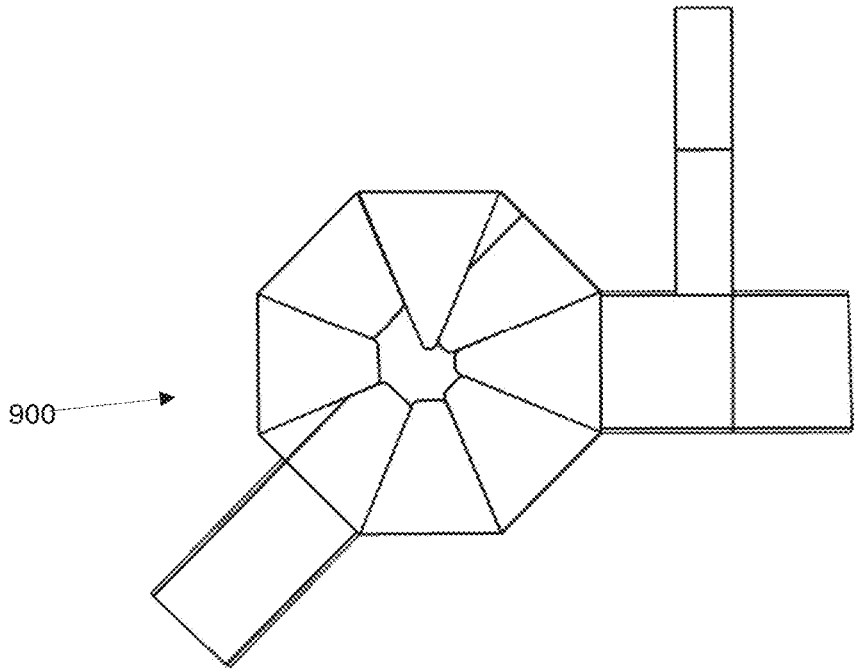

Referring to FIG. 36, the deployable shoe sole 900 comprises a sole ceiling 910 from which extends an array of support elements 920. Each support element 920 includes first and second inclined surfaces 922 and 923 that define channels 921 between adjacent elements. These channels facilitate load distribution and alignment in the deployed state. Additionally, each support element 920 features a base surface 924 designed for ground contact and is connected to the sole ceiling 910 via a living hinge 925, allowing for controlled movement during the rolling transformation.

In the deployed configuration, the support elements 920 are positioned upright to provide stable and uniform foot support. The channels 921 between adjacent support elements maintain a first maximal width W1, ensuring adequate load distribution and structural stability. The inclined surfaces 922 and 923 form an angle with the vertical, typically ranging between 30 and 60 degrees, optimizing the design for both load-bearing capacity and the transformability of the structure. The support elements are aligned in rows along the longitudinal axis of the sole, establishing continuous support paths that span the heel to the toe regions of the sole.

The support elements 920 may vary in height along the sole length. Elements in the heel region may be taller to accommodate greater loads typically experienced in this region, while shorter elements in the forefoot region provide enhanced flexibility. This height variation not only ensures tailored support across different regions of the foot but also facilitates a smooth rolling motion during the transformation process. Furthermore, some support elements may have different base surface heights, enabling customized pressure distribution patterns and adapting the sole's support characteristics to specific user requirements.

Figure 41:
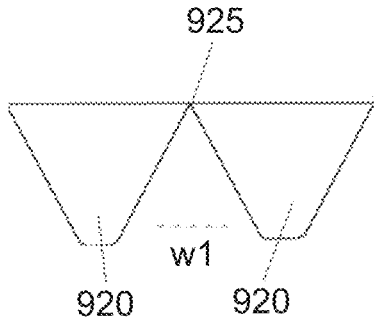
FIGS. 39 to 41 show a reverse deployment sequence in close view focusing on two support elements of the deployable shoe with the deployable sole of FIG. 36.
Figure 40:
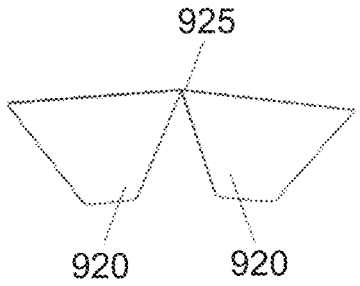
Figure 39:
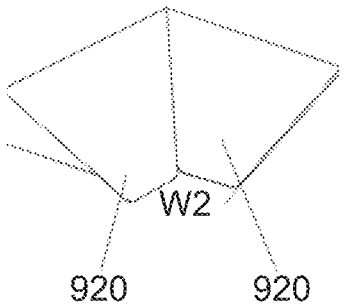

FIGS. 39 to 41 illustrate the transformation sequence from the deployed configuration to the rolled configuration. During this process, the relative positioning of adjacent support elements is maintained through their geometric relationships. The channels 921 progressively narrows from the first maximal width W1 to a second maximal width W2, which is smaller than W1, ultimately reaching zero width as the sole transitions into the fully rolled state. In this rolled configuration, shown in FIGS. 41 and 38, the inclined surfaces 922 and 923 of adjacent support elements come into full abutting contact, and the support elements align themselves along a curved path CP. In this state, the base surfaces 924 of the support elements are arranged sequentially along the curved path CP, forming a compact and space-efficient arrangement. The living hinges 925 accommodate this transformation, preserving the structural connection between the support elements and the sole ceiling 910.

The transformation between the deployed and rolled states follows a predetermined path dictated by the geometry of the support elements. The inclined surfaces of adjacent elements include alignment features designed to prevent lateral deviation, ensuring consistent rolling along the intended path. This controlled transformation protects the structural integrity of the support elements while enabling repeated transitions between the deployed and rolled states without degradation. The interaction between adjacent support elements during rolling is governed by their geometric features, ensuring smooth and reliable operation.

It should be appreciated that any one of the above-described embodiments may incorporate a locking mechanism to maintain the sole in a stable deployed state. Such am exemplary locking mechanism has already been illustrated and described above with reference to FIG. 33. As another example, a locking mechanism can be incorporated in the rolling sole configuration, as well as other configurations, including the nested elements or rotatable inserts embodiments. The locking mechanism ensures that the sole remains securely in its deployed state during use, enhancing the overall functionality and reliability of the deployable shoe sole.

Figure 42:
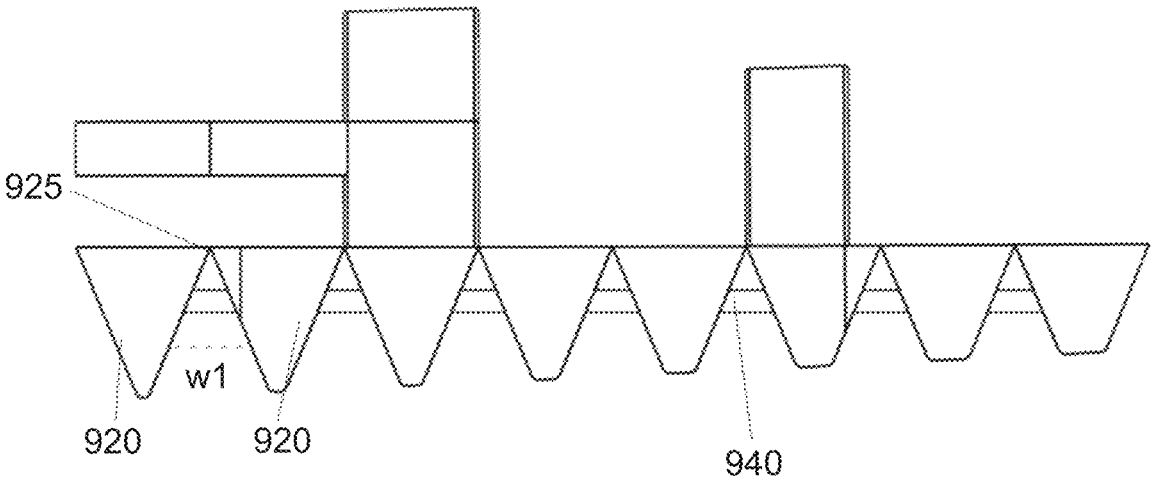
FIG. 42 shows a side view of a deployable shoe according to yet another embodiment of the presently disclosed subject matter, where the deployable shoe and the deployable sole are similar to that of FIG. 36, however with the deployable sole incorporating a receiving arrangement in the form of a series of aligned holes in its support elements, adapted for receiving a locking member in the form of a rigid rod, also shown in the figure, intended to maintain the orientation of the support elements so that the deployable sole will remain in its deployed configuration.
Figure 43:
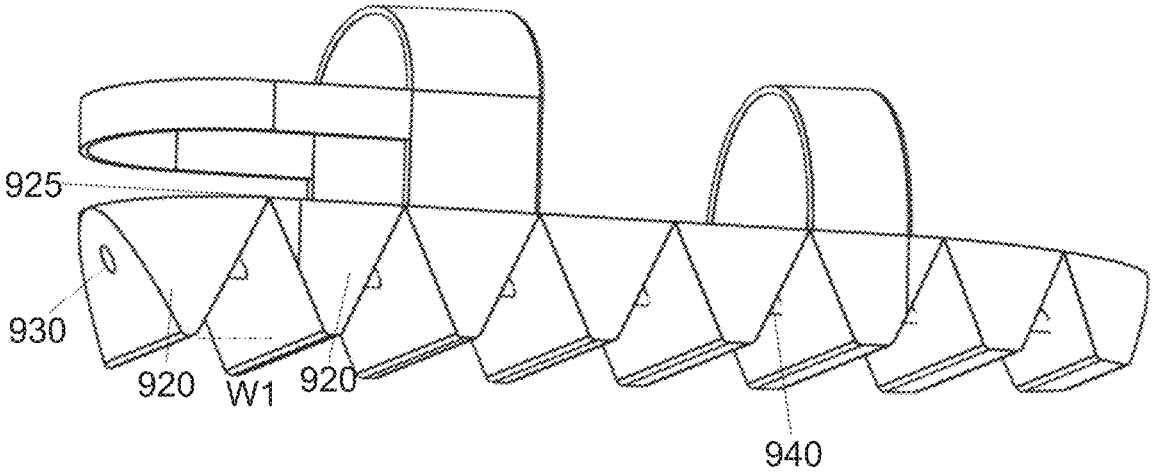
FIG. 43 shows a bottom-rear perspective view of the deployable shoe with the deployable sole of FIG. 36, with a locking member in position.
Figure 44:
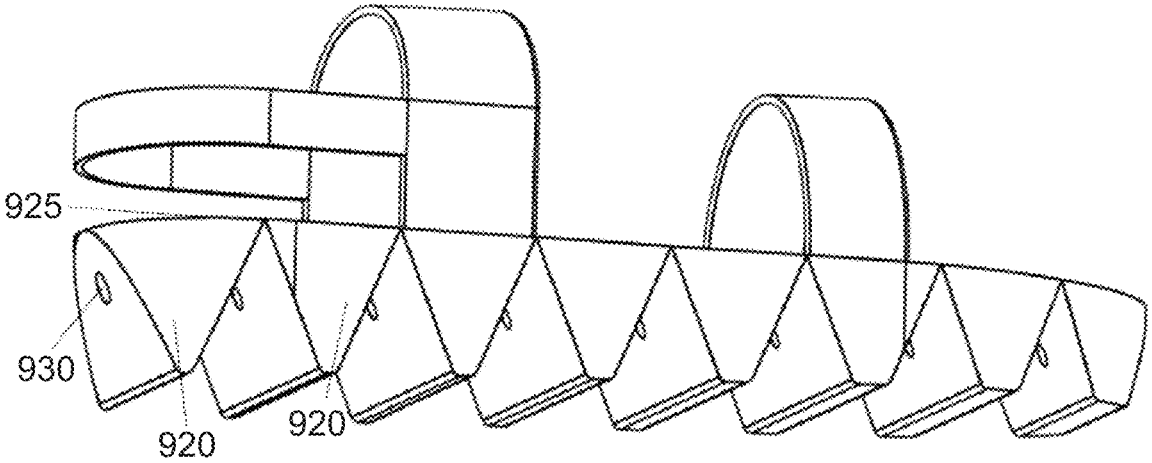
FIG. 44 shows a bottom-rear perspective view of the deployable shoe with the deployable sole of FIG. 42, without the locking member shown.

Referring to FIGS. 42-44, this configuration of the rolling sole incorporates a locking mechanism designed to maintain its deployed state. The support elements 920 are provided with a receiving arrangement in the form of a series of aligned holes 930 extending through their structure. These holes are precisely positioned within each support element to create a continuous passage when the elements are properly arranged in the deployed state.

Figure 45:
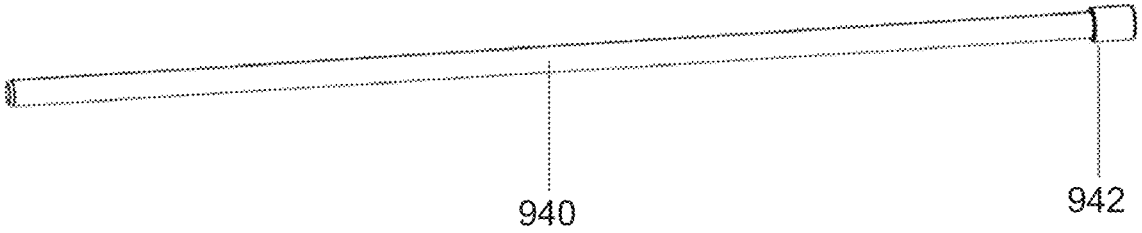
FIG. 45 shows an isolated view of a locking member in the form of a rigid rod according to an embodiment of the presently disclosed subject matter, which is also used in the deployable shoe with the deployable sole of FIG. 44, and has an rimmed edge.
Figure 46:
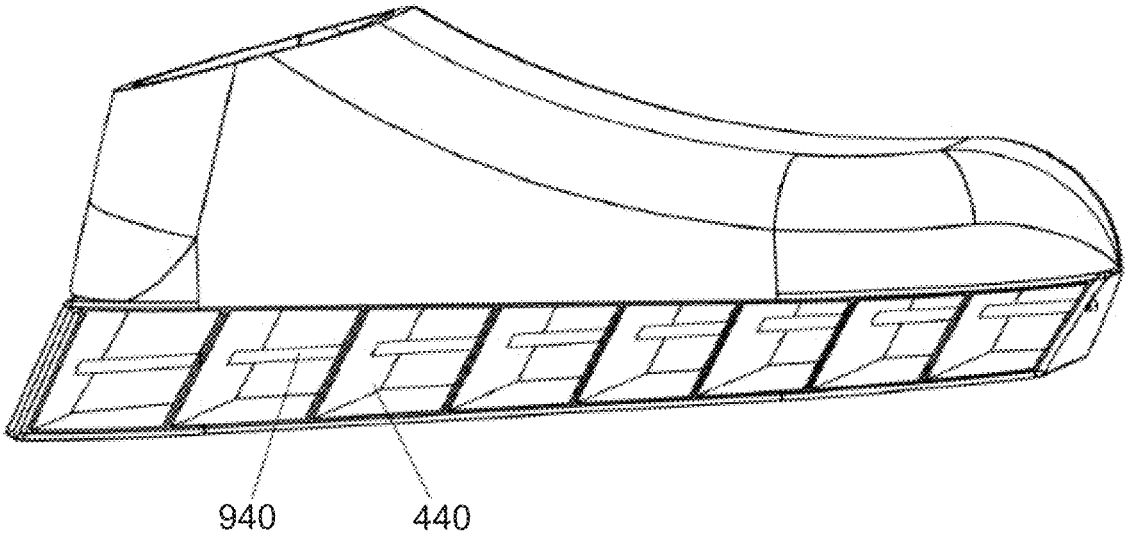
FIG. 46 shows a perspective view of a deployable shoe according to yet another embodiment of the presently disclosed subject matter, where the deployable shoe and the deployable sole are similar to that of FIG. 25, however with the deployable sole incorporating a receiving arrangement in the form of a series of aligned holes in its nested elements, adapted for receiving a locking member in the form of a rigid rod, also shown in the figure, intended to maintain the nested elements in place so that the deployable sole will remain in its deployed configuration.
Figure 47:
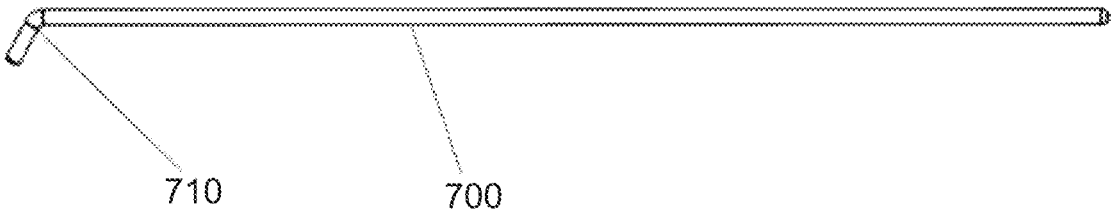
FIG. 47 shows an isolated view of a locking member in the form of a rigid rod according to another embodiment of the presently disclosed subject matter, which is also used in the deployable shoe with the deployable sole of FIG. 49, having a bent edge.

The locking mechanism utilizes a locking member shown in isolation in FIG. 45. This locking member comprises a rigid rod 940 having a rimmed edge 942 at one end. The rod is dimensioned to extend through the entire series of aligned holes 930, with its length corresponding to that of the sole. The rimmed edge 942 is configured to engage with a rear portion of the sole structure, providing both positive positioning of the rod and prevention of unintended removal. As particularly shown in FIG. 42, when the rod 940 is inserted through the aligned holes 930, it effectively prevents any relative hinged movement of the support elements that could initiate rolling. The positioning of the holes 930 within the support elements is engineered such that the rod 940, when inserted, blocks any tendency of the elements to a hinged rotation about living hinge 425. This creates a stable, locked configuration suitable for walking or running.

FIG. 43 provides a rear-bottom perspective view, demonstrating how the rod 940 extends through the entire array of support elements. The alignment of holes 930 creates not only a passage for the rod but also ensures proper positioning of each support element relative to its neighbors. This maintains the intended geometric relationships between elements that provide optimal support characteristics. FIG. 44 illustrates the sole structure prepared for rod insertion, showing how precisely the holes 930 align in the deployed state. The alignment of these holes serves as both a guide for rod insertion and confirmation of proper deployment. When transformation to the rolled state is desired, the rod 940 can be intentionally removed, allowing the support elements to undergo their controlled rolling motion while maintaining their proper geometric relationships.

The dimensional relationships between the holes 930 and the rod 940 are engineered to create a snug fit that prevents unwanted movement while enabling smooth insertion and removal when intended. Each hole 930 is oriented perpendicular to its support element's primary load-bearing axis, ensuring the rod 940 can effectively resist forces that would otherwise initiate rolling. The rimmed edge 942 of the rod 940 serves multiple functions beyond preventing unintended removal. Its engagement with the rear portion of the sole creates a reference point for proper insertion depth. The rim geometry is designed to seat securely against the sole structure while remaining easily accessible for intentional removal. This rim configuration also helps guide initial alignment during insertion. When fully inserted, the rod 940 creates continuous support that complements the inherent stability of the deployed support elements. The positioning of the holes 930 ensures that the rod experiences primarily shear forces during normal use, maximizing its ability to maintain the deployed configuration. The rod's presence through the aligned elements also enhances lateral stability of the sole structure.

The removal sequence is engineered to require deliberate action, preventing accidental release during use while maintaining ease of intentional transformation. When the rod 940 is removed, the support elements maintain their alignment through their geometric relationships until rolling is intentionally initiated. The interaction between adjacent support elements during rolling is controlled through specific geometric features. During the rolling motion, as one element begins to tilt, its inclined surfaces guide the movement of adjacent elements through their predetermined geometrical relationships. This creates a cascading effect where the motion of each element initiates and controls the movement of its neighbors, ensuring smooth and controlled transformation. The support elements maintain their relative positioning through this movement sequence, with their channels progressively changing width while preventing any lateral deviation from the intended rolling path.

Figure 48:
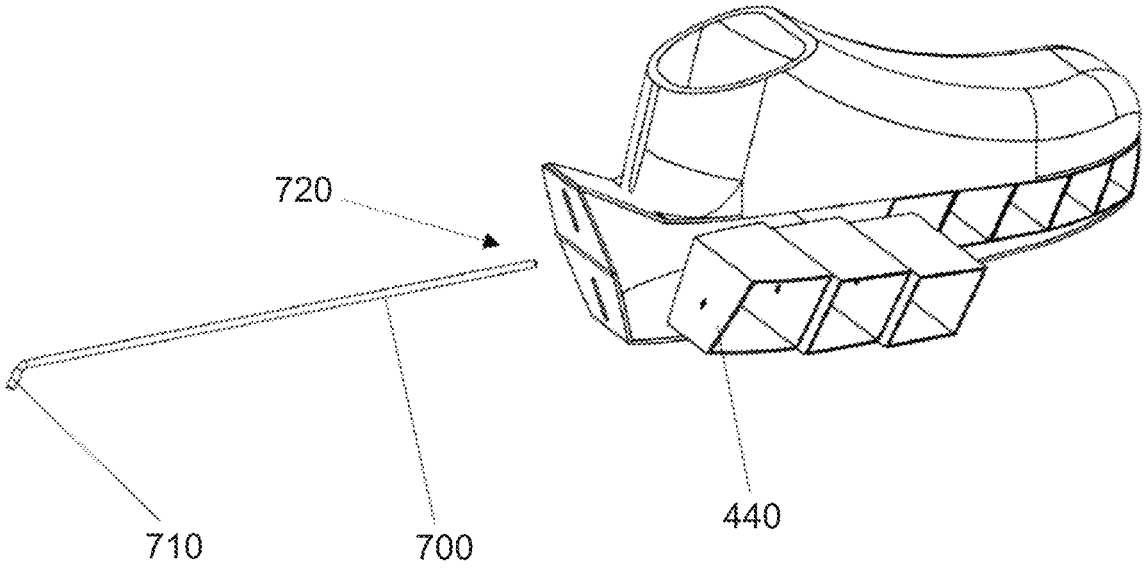
FIG. 48 shows a perspective view of the deployable shoe with the deployable sole of FIG. 49, in a transition state between a compacted and deployed states, in which the locking member/rod is shown extracted from all the nested elements and from a rear insertion and accommodation mechanism in the form of two overlapping slits formed in the fixating fold of the deployable shoe, with a covering portion above them adapted to cover the bent edge of the locking member/rod, once the latter is inserted to the deployable sole, also, some nested elements are seen misplaced outside the deployable sole.
Figure 49:
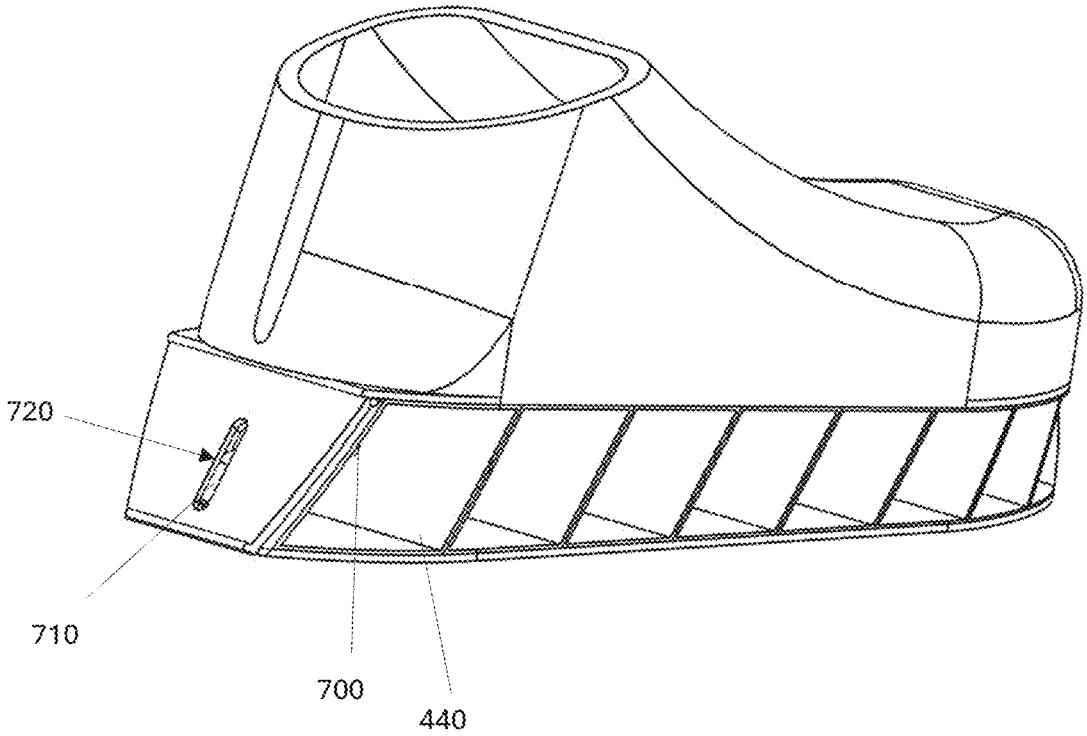
FIG. 49 shows a perspective view from the rear of the deployable shoe with the deployable sole of FIG. 48, in a fully deployed and locked state, where the covering portion shown in FIG. 51 is missing to demonstrate how the bent edge of locking rod/member can be accommodated in the thickness of the accommodation mechanism, with covering portion concealing it (not shown)
Figure 50:
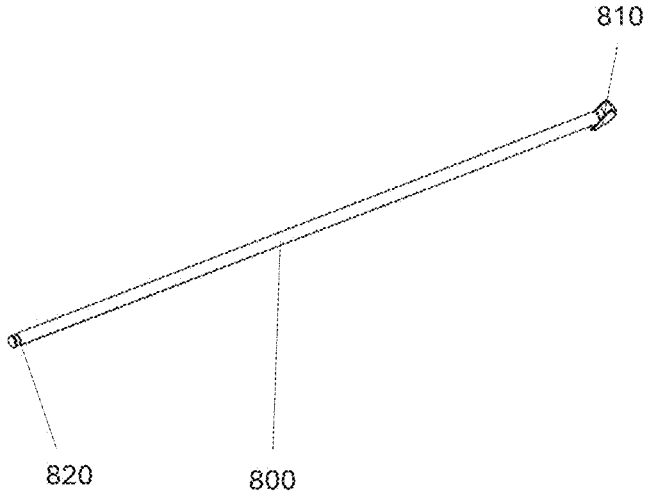
FIG. 50 shows another embodiment of a locking member in the form of a rod, according to the presently disclosed subject matter, having a finger greppable portion at a rear part thereof, and one positioner in the form of a circumferential slit in an edge of the rod adapted for snug fit into a the last hole in the deployable sole or in the respective elements once those are comprised by the deployable sole.

Referring again to FIG. 33 and to FIGS. 46-51, a locking mechanism is further illustrated for various configurations of the deployable sole, including nested hollow elements and rotatable inserts. This mechanism also comprises a receiving arrangement in the form of aligned holes through which a locking member can be inserted. In these configurations, the nested hollow elements or rotatable inserts are provided with through-holes that align in their deployed state to create a continuous passage. A locking member in the form of a rigid rod 940 in FIG. 46 or rod 700 in FIG. 48 or rod can be inserted through this passage. The rod 700 can incorporate different end configurations for secure engagement. For example, FIG. 50 depicts a variation where the rod includes a bent edge 710 that engages with a rear portion of the sole structure. FIGS. 48-49 demonstrate how the sole structure incorporates an accommodation mechanism 720 in the form of overlapping slits configured to receive and secure the rod's edge portion. This arrangement provides both guide features for insertion and securing features to maintain engagement.

As shown in FIG. 49, when viewed from behind, the accommodation mechanism 720 is configured to conceal the bent edge of the rod within its thickness by incorporating an excess concealing fold. This arrangement protects the edge while maintaining a clean external appearance. The overlapping slits are dimensioned to enable single-handed insertion and removal of the rod while preventing accidental disengagement during use.

Figure 53:
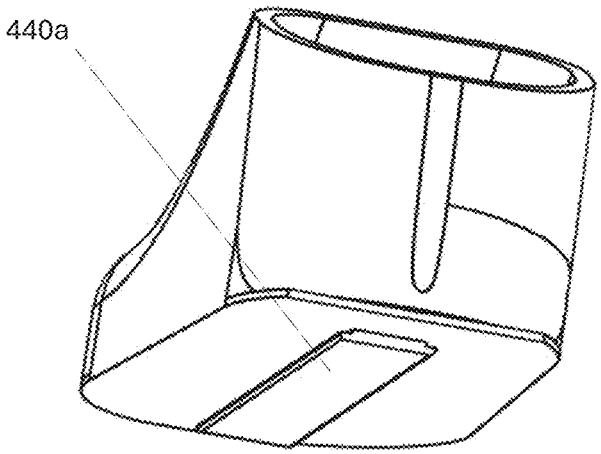

FIG. 53 presents another variation of the locking member, where the rod 800 incorporates a finger-grippable portion 810 at its rear end. This enhanced gripping feature facilitates easier handling during insertion and removal. The rod 800 also includes a positioning feature in the form of a circumferential slit 820 near its edge, configured for snug engagement with the last hole in the series, providing positive confirmation of proper insertion.

The locking mechanism is adaptable across different deployable sole configurations while maintaining its core functionality of secure deployment and intentional release. It ensures that the nested hollow elements, rotatable inserts, or rolling support elements remain in position during use while allowing for controlled transitions between states. The described locking mechanism principles can be scaled and adapted for various applications, enabling secure and stable functionality across diverse structural arrangements.

It should be appreciated that any embodiment of a sole, deployable or not, according to the presently disclosed subject matter which is presented herein can also include means for connecting it to an upper of the shoe considering the deployable nature of the sole.

Figure 51:
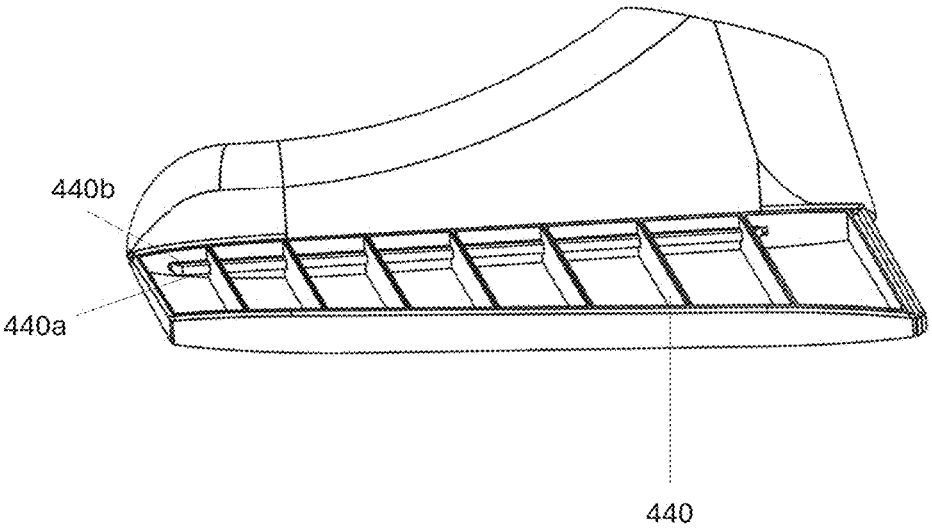
FIG. 51 shows a perspective view from below of a nested elements\inserts with a fixing mechanism for keeping them in place in a deployed configuration, and for connecting them to the upper of a deployed shoe and sole according to another embodiment of the presently disclosed subject matter.
Figure 52:
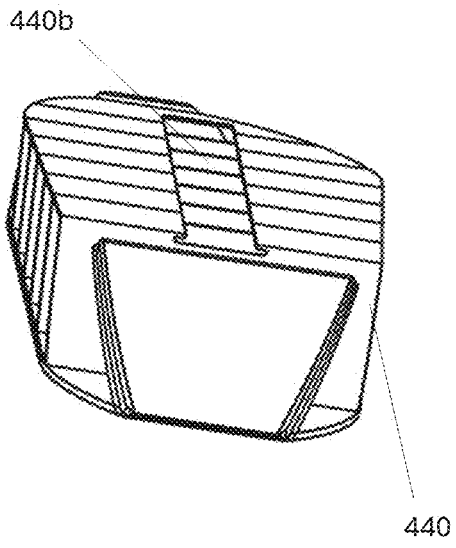
FIGS. 52 and 53 show, respectively, perspective view from above of the deployable sole of the deployable shoe of FIG. 26, and perspective view from below of the upper of the deployable sole of the deployable shoe of FIG. 26.

For example, as illustrated in FIGS. 51 to 53, each hollow element 440 may also include mating guide features 440*b* that cooperate with the alignment feature 440*a* to maintain proper positioning. In one example, the alignment feature extends along the length of the sole, while the guide feature includes a dove-tail connection. In such configurations, one of the alignment feature and the guide feature comprises a dove-tail shaped projection, and the other comprises a corresponding dove-tail shaped depression. This coupling ensures secure placement and proper alignment of the hollow elements 440 during deployment and use.

Figure 54:
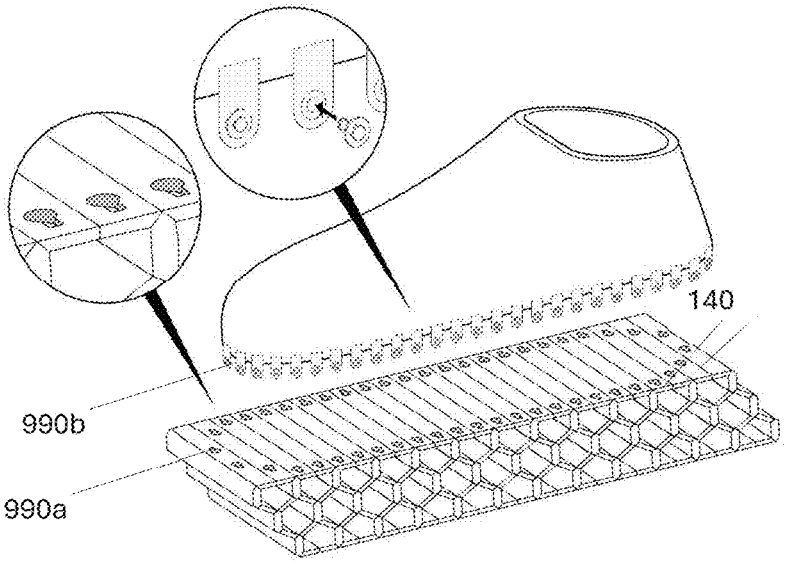
FIG. 54 shows a perspective view from below of a deployable sole incorporating angularly deployable structural elements with a fixing mechanism for keeping them in place in a deployed configuration and for connecting them to the upper of a deployed shoe and sole according to another embodiment of the presently disclosed subject matter.

A further example is shown in FIG. 54, in which a plurality of structural elements, particularly herein a plurality of geometrically locking structural elements 140,150, are formed with built in receiving slots 990*a*, while the upper is formed with corresponding mating pins 990*b* receivable by the slots. In the present example the slots 990*a* are in the form of key holes and the pins 990*b* have corresponding shoulders suitable for insertion through the wide part of the keyhole shaped slots, and for sliding towards the narrow portion so as to lock the shoulders beneath it.

The slots and pins are arranged around the circumference of the upper\sole, so as to achieve counter resistance once locked.

The upper of the sole can be made of flexible material, such as fabric, allowing it to assume a compacted and deployed states with or independent of the deployable sole.

It should also be appreciated that each of the embodiments presented herein can achieve an adjustable level of bounciness in the deployed state, either through selection of materials in the manufacturing level, or by manipulation of elements in the transition between compacted and deployed positions, as in the insert example. For example, elements of which the soles are constituted, e.g., the spacer elements 240, can be made of rubber or other resilient compressible material for achieving bounciness of the sole.

The invention claimed is:

1. A deployable shoe sole configured to undergo deployment from a compacted state to a deployed state, the sole incorporating a deployable structure, the sole comprising:

a first structural element; and a second structural element hingedly connected to the first structural element so as to enable hinged movement between the first structural element and the second structural element at least in a deployment direction;

wherein the first structural element has a first abutment surface and the second structural element has a second abutment surface, the first and second abutment surfaces being congruent;

and wherein, in the compacted state the first and second abutment surfaces are separated, and in the deployed state the abutment surfaces abut each other so as to limit further hinged movement between the first structural element and the second structural element in the deployment direction.

2. The deployable shoe sole according to claim 1, wherein in the compacted state, the first and second abutment surfaces form an angle therebetween.

3. The deployable shoe sole according to claim 2, wherein the angle formed between the first and second abutment surfaces in the compacted state is greater than 30 degrees.

4. The deployable shoe sole according to claim 1, wherein the first and second abutment surfaces are flat.

5. The deployable shoe sole according to claim 1, wherein the first structural element is a load bearing structural element and the second structural element is a geometrically locking structural element oriented laterally thereto in the deployed state of the sole, the geometrically locking structural element having a load bearing abutment surface configured to abut an abutment surface of the load bearing structural element in the deployed state of the sole, and a geometrically locking abutment surface configured to abut an abutment surface of another geometrically locking structural element.

6. The deployable shoe sole according to claim 5, wherein the geometrically locking structural element is oriented perpendicularly to the load bearing structural element in the deployed state of the sole.

7. The deployable shoe sole according to claim 5, wherein the geometrically locking structural element being hingedly connected at one end thereof to the load bearing structural element and at the opposite end thereof to a like-geometrically locking structural element being parallel thereto in the deployed state of the sole.

8. The deployable shoe sole according to claim 5, wherein each of the geometrically locking structural elements has a locking abutment surface abutting a respective locking abutment surface and arranged parallel to a direction of expected load to be applied on the sole, at the deployed state of the sole.

9. The deployable shoe sole according to claim 8, wherein the abutment surfaces of the geometrically locking structural elements are configured to change their orientation by more than 60 degrees between the compacted and deployed states.

10. The deployable shoe sole according to claim 5, wherein geometrically locking structural elements extend along a bottommost and/or topmost parts of the sole.

11. The deployable shoe sole according to claim 1, further comprising, in addition to said first and second structural elements, a plurality of first and second structural elements, said structural elements being so connected as to create a repeating pattern.

12. The deployable shoe sole according to claim 11, wherein the repeating pattern includes polygonal spaces in between structural elements.

13. The deployable shoe sole according to claim 12, wherein the polygonal spaces include n sides in a center portion of the sole, and n−1 sides on topmost and/or bottommost portions of the sole.

14. The deployable shoe sole according to claim 11, wherein said first and second structural elements are configured such that transition between states initiates corresponding transition of all other structural elements.

15. The deployable shoe sole according to claim 11, wherein each of the abutment surfaces is configured such that the abutment thereof in the pattern occurs simultaneously.

16. The deployable shoe sole according to claim 1, wherein each of the first and second structural elements comprises a portion of rigid material from which the respective abutment surface is made.

17. The deployable shoe sole according to claim 16, further comprising a flexible material connecting the portions of rigid material of the first and second structural elements.

18. The deployable shoe sole according to claim 17, wherein the flexible material facilitates the hinged connection between the first and second structural elements.

19. The deployable shoe sole according to claim 11, wherein: each first structural element is hingedly connected to at least two second structural elements; and each second structural element is hingedly connected to at least two first structural elements, thereby forming a repeating hexagonal pattern in the deployed state.

* * * * *